US009398356B2

(12) United States Patent
Roberts

(10) Patent No.: US 9,398,356 B2
(45) Date of Patent: Jul. 19, 2016

(54) HOUSING, A SUPPORT, AN ASSEMBLY, AND A METHOD OF MANUFACTURE

(71) Applicant: Flare Audio Holdings Limited, Lancing (GB)

(72) Inventor: Davies Richard Roberts, Shoreham-by-Sea (GB)

(73) Assignee: FLARE AUDIO TECHNOLOGIES LIMITED, Lancing, West Sussex (GB)

( * ) Notice: Subject to any disclaimer, the term of this patent is extended or adjusted under 35 U.S.C. 154(b) by 0 days.

(21) Appl. No.: 14/433,594

(22) PCT Filed: Oct. 4, 2013

(86) PCT No.: PCT/GB2013/052589
§ 371 (c)(1),
(2) Date: Apr. 3, 2015

(87) PCT Pub. No.: WO2014/057249
PCT Pub. Date: Apr. 17, 2014

(65) Prior Publication Data

US 2015/0208149 A1 Jul. 23, 2015

(30) Foreign Application Priority Data

| | | |
|---|---|---|
| Oct. 8, 2012 | (GB) | 1218000.6 |
| Dec. 7, 2012 | (GB) | 1222046.3 |
| Jan. 15, 2013 | (GB) | 1300708.3 |
| Feb. 6, 2013 | (GB) | 1302065.6 |
| May 23, 2013 | (GB) | 1309313.3 |

(51) Int. Cl.
*H04R 1/02* (2006.01)
*H04R 31/00* (2006.01)

(52) U.S. Cl.
CPC ..... *H04R 1/02* (2013.01); *H04R 1/021* (2013.01); *H04R 31/00* (2013.01); *Y10T 29/49005* (2015.01)

(58) Field of Classification Search
CPC ..... H04R 1/42; H04R 1/28; H04R 1/2815–1/2826; H04R 1/02; H04R 1/025; H04R 1/026
USPC ..... 381/345, 349, 162, 386, 306, 333, 388
See application file for complete search history.

(56) References Cited

U.S. PATENT DOCUMENTS 4,509,615 A 4/1985 Hruby
4,591,020 A 5/1986 Hruby, Jr.

(Continued)

FOREIGN PATENT DOCUMENTS

DE 19836790 C1 4/1999
FR 2777409 A1 10/1999

(Continued)

OTHER PUBLICATIONS

Combined Search and Examination Report under Sections 17 & 18(3), GB Application No. GB1218000.6, Intellectual Property Office, Jan. 8, 2013.

(Continued)

*Primary Examiner* — Suhan Ni
(74) *Attorney, Agent, or Firm* — Robert G. Crouch; Marsh Fischmann & Breyfogle LLP

(57) ABSTRACT

A loudspeaker (130) comprises an electro-acoustic transducer such as a loudspeaker driver (135) mounted to a housing. The housing has side walls (132) subjected to a compressive force by bolts (50), which may extend between rigid end plates (133, 134). The side walls may be formed by a stack of plates. The housing defines a recess such that when the loudspeaker driver (135) is mounted in the housing, there is a cavity behind the loudspeaker driver (135). Such a housing may be used for a range of different electro-acoustic transducers. The compressive force suppresses resonance and improves performance of the electro-acoustic transducer.

26 Claims, 9 Drawing Sheets

(56) References Cited

U.S. PATENT DOCUMENTS

| | | | | |
|---|---|---|---|---|
| 5,661,271 | A | 8/1997 | Moser | |
| 6,763,117 | B2 * | 7/2004 | Goldslager ..... | H04R 1/02 381/345 |
| 2003/0063766 | A1 | 4/2003 | Goldslager et al. | |
| 2005/0022918 | A1 | 2/2005 | McCain | |
| 2005/0133298 | A1 | 6/2005 | Hasegawa | |

FOREIGN PATENT DOCUMENTS

| | | | |
|---|---|---|---|
| JP | 57084700 | | 5/1982 |
| JP | 57188199 | | 11/1982 |
| JP | 02195800 | | 8/1990 |
| JP | 02199996 | | 8/1990 |
| JP | 11252690 | | 9/1999 |
| NL | 1003216 | | 12/1997 |
| WO | 0165533 | A2 | 9/2001 |

OTHER PUBLICATIONS

Search Report under Section 17, GB Application No. GB1317559.1, Intellectual Property Office, May 14, 2014.

Search Report under Section 17, GB Application No. GB1222046.3, Intellectual Property Office, Apr. 3, 2013.

International Search Report and Written Opinion of the International Searching Authority, PCT Application No. PCT/GB2013/052589, Feb. 17, 2014.

* cited by examiner

Fig.18.
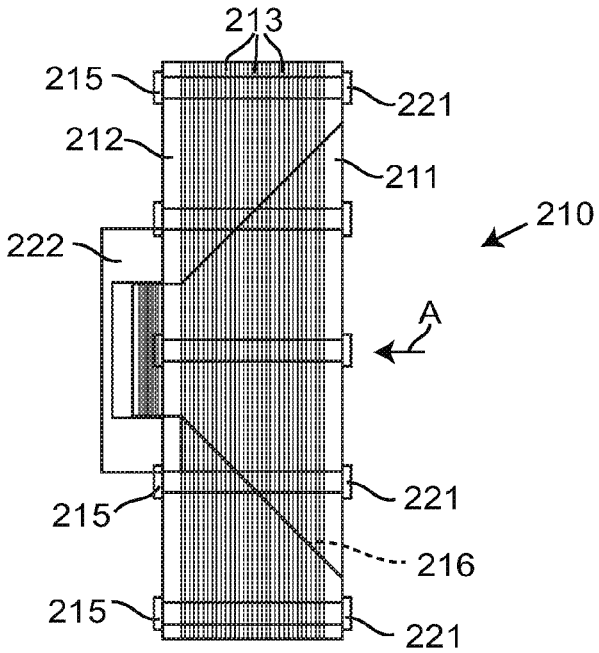
Fig.18c.
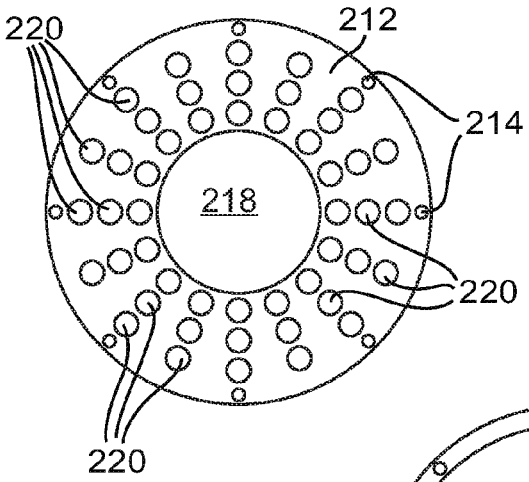
Fig.18a.
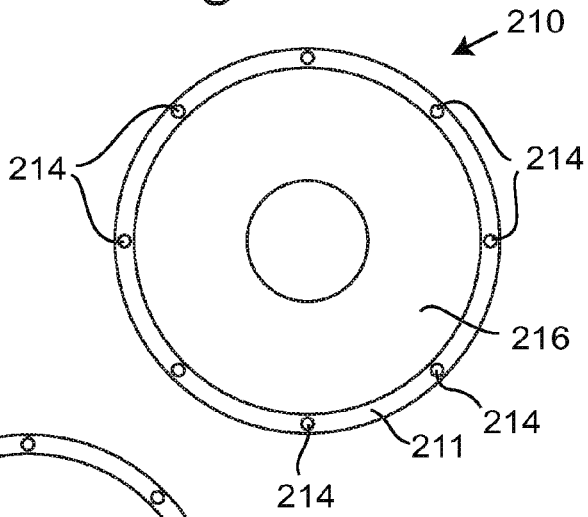
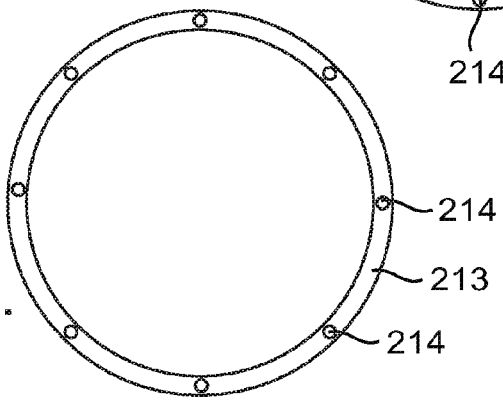
Fig.18b.

HOUSING, A SUPPORT, AN ASSEMBLY, AND A METHOD OF MANUFACTURE

TECHNICAL FIELD

This disclosure relates to a housing and a support suitable for an electro-acoustic transducer such as a loudspeaker, and to a method of manufacturing the housing.

BACKGROUND

A loudspeaker usually incorporates a loudspeaker driver, which incorporates a movable element which is supported resiliently, and driven to oscillate so as to create a sound wave, and a loudspeaker enclosure to which the loudspeaker driver is mounted. For example the movable element may be driven electromagnetically. In one case, a cone is supported resiliently at its wider end in a support frame, and a driver coil is attached to the narrower and of the cone, the driver coil locating in a magnetic field from a magnet which is also fixed relative to the support frame. By applying varying electrical currents to the coil, the driver coil is caused to move in the magnetic field, and hence the loudspeaker cone oscillates in order to produce sound. Whatever the shape of the movable element, a loudspeaker driver requires a support frame to which the movable element is attached, and the driving means is also fixed relative to the support frame. The shape, material and construction of the loudspeaker enclosure, along with the way in which the loudspeaker driver is mounted to the loudspeaker enclosure, have a strong influence on the quality of sound output by the loudspeaker. A loudspeaker driver is an example of an electro-acoustic transducer. Similar issues arise with other electro-acoustic transducers, such as microphones or headphones.

A particular problem is that the walls of the loudspeaker enclosure tend to vibrate under the influence of the sound produced by the loudspeaker driver. The vibration is particularly noticeable at the resonant frequencies of the walls. Efforts have been made to design loudspeaker enclosures with walls that do not vibrate significantly, or resonate at frequencies outside of the range of sound frequencies produced by the loudspeaker driver. For example, some enclosure designs feature internal bracing to reinforce the walls. Generally, designs that reduce vibration tend to be more complex to build, and are therefore more expensive to manufacture. They can also be relatively heavy, which is particularly disadvantageous for loudspeakers that are intended to be hung, or to be portable. Moreover, whatever the design, some vibrations inevitably persist, leading to a reduction in the quality of the sound output by the loudspeaker.

As regards the driver, a common type of support frame is of cast aluminium, defining a rigid ring to which the movable element is mounted; a rigid end plate to support a magnet; and a number of rigid struts to link the rigid ring to the rigid end plate. Gaps between the rigid struts ensure that the space between the support frame and the movable element is not enclosed. All the elements of the support frame are integral with each other, and are intended to be rigid in order to inhibit vibrations. This has the consequence that they are quite heavy. For example the support frame for a loudspeaker driver of diameter 0.45 m would typically be of cast aluminium, with a mass of about 15 kg.

SUMMARY

According to a first aspect, there is provided a housing suitable for use as a housing for an electro-acoustic transducer, wherein the housing comprises at least one sidewall defined by at least one element held under compressive force, and wherein the housing defines a recess in which the electro-acoustic transducer may be mounted.

Although the housing is primarily intended as a housing to accommodate a loudspeaker driver, that is to say a source of sound, it will be appreciated that the housing might instead be used as a housing for another type of electro-acoustic transducer such as a microphone, that is to say a sound receiver.

According to another aspect of the present invention there is provided an assembly comprising a housing for an electro-acoustic transducer, and an electro-acoustic transducer, wherein the housing comprises at least one sidewall defined by at least one element held under compressive force, and wherein the housing defines a recess in which the electro-acoustic transducer is mounted.

The invention is also applicable to a support frame for an electro-acoustic transducer. Hence, in another aspect, there is provided a support frame suitable for an electro-acoustic transducer, wherein the support frame comprises at least one sidewall defined by at least one element, and means to hold the sidewall under compressive force.

According to a further aspect, the present invention provides an electro-acoustic transducer comprising a support frame and a movable element connected to a driving means; wherein the support frame comprises at least one sidewall defined by at least one element, and means to hold the sidewall under compressive force.

The support frame usually defines apertures for free flow of air. Such apertures ensure that the movable element can move relative to the support frame without generating pressure fluctuations that are detrimental to its operation. The advantage of such apertures therefore depends upon the relative sizes of the movable element and of the cavity defined by the support frame.

The housing or the support frame may include a compressing member which holds each element under compressive force. For example the housing or the support frame may include a front plate and a back plate, spaced apart by side walls, with compressing members extending between the front plate and the back plate to exert a compressive force on the side walls. Each sidewall may be of unitary form, or may comprise a plurality of wall elements held together. The wall elements may be held together by an adhesive. The wall elements may be held together by the compressing members. The compressing member may extend through the wall elements, to subject them to compressive force.

The compressing members may act on force-spreading plates, the force-spreading plates being sufficiently rigid to subject the side walls to substantially uniform compressive force. Where there is a front plate and a back plate, these plates may have the attributes of the force-spreading plates, providing the requisite stiffness or rigidity. The force-spreading plates may also be harder than the material of the side walls.

The sidewall may therefore be of laminated construction, comprising a plurality of layers held together under compressive force. For example a rectangular housing may be formed of a plurality of rectangular sheets or laminae held together, at least one of the sheets or laminae defining an aperture to form the recess in the housing. As another example a cylindrical support frame may be formed of a plurality of annular sheets or laminae held together, and held under compressive force. The apertures for free flow of air may be defined in an end plate, or may be defined in sidewalls, for example by constructing cylindrical walls with slots, by stacking spacer blocks which may be arcuate. Alternatively apertures may be defined in an end plate and also in the sidewalls.

For example in either a housing or a support frame there might be between two and a hundred or more, more typically between five and thirty such sheets or laminae held together to define walls of the housing or the support frame. The number of sheets or laminae is determined by the thickness of each sheet, and by the desired thickness of the housing or the support frame.

Applying a compressive force to the housing or the support frame can increase its stiffness, thereby reducing the amplitude of any vibrations. Moreover, a stiffer housing or support frame can have higher resonant frequencies, reducing or even eliminating resonance at frequencies at which the electro-acoustic transducer operates. Thus an effect of the compressive force is that of reducing or eliminating resonance at operating frequencies; and consequently the compressive force is desirably applied so that the side walls are under substantially uniform compression, and so are uniformly rigid. The resulting driver or loudspeaker can be expected to have a flatter frequency response As regards the loudspeaker, when the electro-acoustic transducer is mounted in the recess, the housing may define an airtight cavity behind the electro-acoustic transducer.

According to another aspect, the present invention provides a method of manufacturing a loudspeaker, the method comprising mounting a loudspeaker driver to a housing, wherein the housing comprises at least one sidewall defined by at least one element, the housing defining a recess in which the loudspeaker driver is mounted, so defining a cavity behind the loudspeaker driver; and subjecting the at least one element of the at least one sidewall to a compressive force.

In each aspect of the invention the compressing member may comprise one or more bolts. The bolts may be of steel; in some applications other materials such as titanium or brass would also be suitable.

The compressive force increases the rigidity or stiffness of the side walls of the housing or the support frame. An additional benefit of the compressive force is to prevent separate elements moving or resonating individually. The overall result is that resonance of the housing or the support frame is suppressed in the audible frequency range. The compressive force may be applied in a direction parallel to the direction of movement of the electro-acoustic transducer, or of the movable element of the electro-acoustic transducer.

The compressive force must be applied such that side walls are all under substantially uniform compression and so are uniformly rigid; and if there are also internal walls or baffles, they must also be subjected to substantially uniform compression. So for example compressing members (such as bolts) should be sufficiently close together throughout the side walls and any internal walls or baffles that portions that are between adjacent compressing members remain under sufficient compression. The side walls may be of laminated or layered construction, comprising a plurality of layers held together and under compressive force; the layers may be of a material that is not particularly rigid, such as wood, plywood, chipboard, medium-density fibreboard (MDF), or plastic. Alternatively the walls may be unitary. As another alternative, at least one of the front plate and the back plate may be integral with at least part of the side walls.

Where the side walls are of a material that is not particularly rigid, such as wood, plywood, chipboard, MDF, or plastic, the compressing members preferably act on force-spreading plates which are of a more rigid material than that of the walls (whether the walls are of layered or of unitary form). The force-spreading plates must be sufficiently rigid and sufficiently large to achieve substantially uniform compression of the portions of the walls that are between adjacent compressing members. For example the force-spreading plates might be discrete plates to spread the force from one or more discrete compressing members, for example the force-spreading plates may be washers. Alternatively they might be end plates covering the entire end of the housing (although an end plate may define an aperture). In one example the force-spreading plates might be steel washers 30 mm in diameter and of thickness 1 or 2 mm, one for each compressing bolt; while in another example the force-spreading plates may be end plates, for example of a metal such as steel, brass, zinc or aluminium, and of thickness at least 2.5 mm thick, and in some cases 5 or 10 mm thick. Where washers or similar discrete force-spreading plates are used, the force-spreading plates should be sufficiently large that any resulting gap between adjacent force-spreading plates is no more than 20% of the distance between adjacent compressing members, preferably no more than 10%.

Where the walls are of materials such as card, MDF, chipboard, wood, plywood or plastic it has been found that the requisite compressive force is significantly greater than the force that would lead to permanent deformation of the material, if it were not applied through a force-spreading plate. The compressive force is considerably greater than would be applied by a bolt that is merely "tightened" to hold the components together. The force-spreading plates should in this case be of a harder material than that of the walls, so the force-spreading plates are not significantly deformed by the localised load from the bolt; and they are of a more rigid material than that of the walls, so they significantly restrict any distortion of the walls, ensuring uniform compressive force.

The compressive force is applied by one or more compressing members, which may comprise bolts. Where bolts are used, the method includes tightening the bolts to a torque at least 25% greater than that required to hold the elements together. When the elements are of a non-rigid material such as plywood, plastic or MDF, the bolts may have to be tightened to a torque at least twice that required to hold the elements together, and the required torque may be at least four times that required to hold the elements together. During tightening, in the case of such a non-rigid material, the noise provided by tapping the outside of the housing provides a clear indication as to when an adequate compressive force has been achieved, as the tone will change from a dull knock to a much higher pitched note. The effect of the compressive force on the side walls is to suppress resonance of the side walls.

Where the housing is formed of a plurality of layers, and two adjacent layers define at least part of the recess, the two adjacent layers must be joined together in an airtight fashion if the resultant cavity is to be airtight. This may be achieved by providing adhesive between the adjacent layers. Alternatively a seal may be provided between the adjacent layers, the seal being relatively deformable in comparison to the layers. In one example, the seal is an O-ring. Where such a seal is provided, the seal must be deformable into a groove in one or other of the adjacent layers so that the adjacent layers are in contact, and so can be under compressive force.

In another aspect the invention provides a housing suitable for use as a housing for an electro-acoustic transducer, wherein the housing comprises at least one sidewall defined by a multiplicity of sheet elements stacked together, and secured together, and wherein the housing defines a recess in which the electro-acoustic transducer may be mounted. Preferably the sheet elements are in planes that are orthogonal to the direction of movement induced by the electro-acoustic transducer. Furthermore, the invention may provide an assembly comprising such a housing, in combination with an electro-acoustic transducer.

It will be appreciated that loudspeakers are primarily intended for generating audible sound, that is to say sound within the range of frequencies that is audible to a person with normal hearing, which may be taken as about 20 Hz up to about 18 kHz. Nevertheless under some circumstances loudspeakers may be required to generate infra-sound, for example to generate 15 Hz or 10 Hz; and may be required to produce ultrasound frequencies, for example 20 kHz or more. The loudspeakers of the invention can be expected to provide satisfactory performance both in the audible range, and at frequencies above and below the audible range.

The cavity must not only have side walls, but if it is to be airtight it must also have a closure at the rear side, that is the side furthest from the loudspeaker driver. That closure should also be substantially rigid. Where the side walls are subjected to compressive force, that force may be transmitted through the rear closure, so that the assembly of the rear closure and the sidewalls is substantially rigid.

There is no requirement for any damping material within the cavity, and indeed the performance of the loudspeakers of the invention has been found to be better without any damping material within the cavity. There is also no requirement for any bracing or struts within the cavity, although the presence of a strut would not be detrimental to the performance. The shape of the cavity is not critical, although its volume should be matched to the loudspeaker driver (in accordance with manufacturer's recommendations), so that pressure fluctuations within the cavity are not detrimental to the performance of the loudspeaker driver. It may also be desirable to ensure that the surfaces within the cavity are smooth, by machining off any jagged edges.

The support frame of the invention must not only have side walls, but typically also an end member to which the drive means of the transducer may be mounted. That end member should also be substantially rigid. The means that subject the sidewalls to compressive force may be arranged to transmit that force through the end member, so that the assembly of the end member and the sidewalls is substantially rigid.

In another aspect, the invention provides a loudspeaker that includes:

(a) an electro-acoustic transducer comprising a support frame and a movable element connected to a driving means; wherein the support frame comprises sidewalls defined by multiple stacked elements, and means to subject the side walls to compressive force, and at least one end member; and (b) a housing for the electro-acoustic transducer, the housing comprising sidewalls defined by multiple stacked elements held under compressive force, and wherein the housing defines a recess in which the electro-acoustic transducer is mounted.

In such a loudspeaker, the housing and the support frame for the electro-acoustic transducer may be integral with each other. In particular, they may each be formed of sheets laminated together, and at least some of the sheets defining the housing may also define the support frame.

Embodiments of the disclosure are described below, with reference to the accompanying drawings, by way of example only.

BRIEF DESCRIPTION OF THE DRAWINGS

FIG. 18 is a schematic side view of a loudspeaker driver according to a first driver embodiment;

FIG. 18*a* is a view in the direction of arrow A of FIG. 18;

FIG. 18*b* is a plan view of an element forming a sidewall of the loudspeaker driver of FIG. 18; and FIG. 18*c* is a plan view of an element forming a rear wall of the loudspeaker driver of FIG. 18;

DETAILED DESCRIPTION

Housings

In this detailed description, reference is made to loudspeaker housings in several cases, but it will be appreciated that the housings of the invention would be equally suitable for other types of electro-acoustic transducer, such as microphones.

Figure 1:
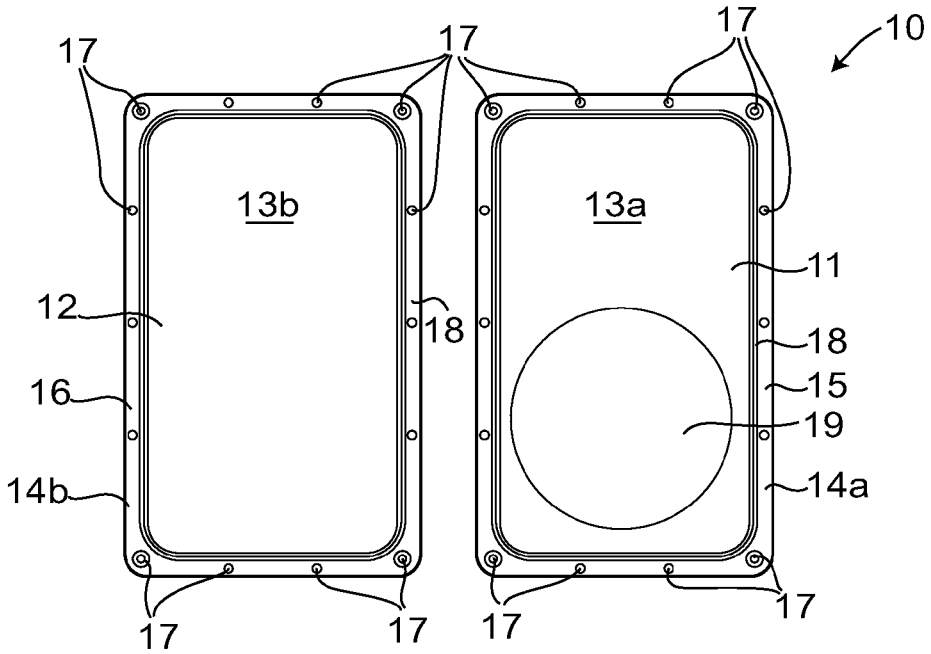
FIG. 1 is a schematic illustration of a loudspeaker according to a first embodiment, showing a front view of a loudspeaker housing in a disassembled state.
Figure 2:
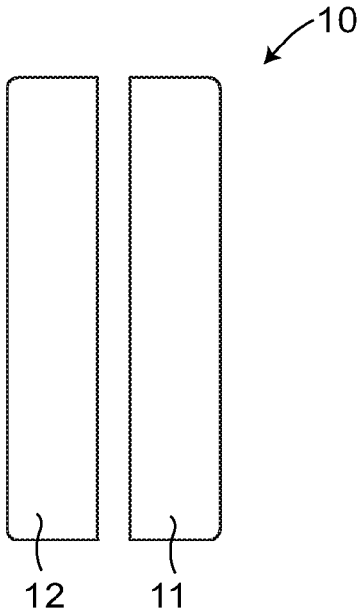
FIG. 2 is a schematic illustration of the loudspeaker according to the first embodiment, showing a side view of the loudspeaker housing in a disassembled state.
Figure 3:
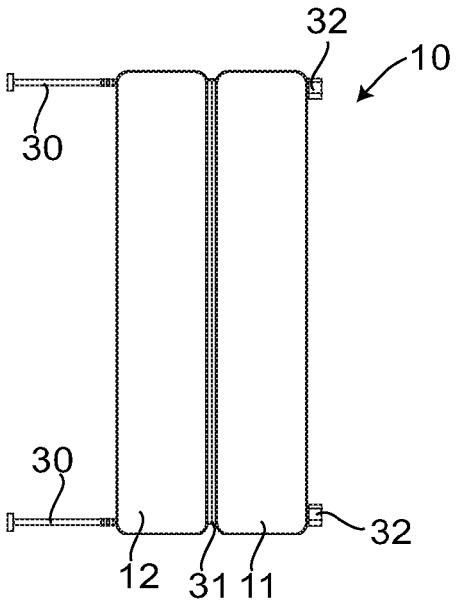
FIG. 3 is a schematic illustration of the loudspeaker according to the first embodiment, showing a side view of the loudspeaker housing during assembly.

Referring to FIGS. 1 to 3, according to a first embodiment there is provided a loudspeaker 10 comprising a front block 11 and a rear block 12. Each of the front block 11 and the rear block 12 is shaped like an open box, defining a recess 13*a*, 13*b* enclosed by a side wall 14*a*, 14*b*. The side walls 14*a* and 14*b* define flat rims 15, 16. The recesses 13*a*, 13*b* and rims 15, 16 are dimensioned such that, when the front and rear blocks 11, 12 are brought together so the rims 15, 16 meet, the recesses 13*a* and 13*b* form a cavity between the front and rear blocks 11, 12. In one example the front block 11 and the rear block 12 are of aluminium, and the side walls 14*a* and 14*b* are of thickness 10 mm.

The rim 15 of the front block 11 mirrors the rim 16 of the rear block 12. This means that when the rims 15, 16 are brought together the edges of the rims 15, 16 align with one another. Each side wall 14*a* and 14*b* has holes 17 that extend from its surface, through the respective block 11, 12. Like the rims 15, 16, the holes 17 in the respective side walls 14*a* and 14*b* mirror one another. When the rims 15, 16 are brought together, the holes 17 align so that bolts 30 can be inserted all the way through both the front and the rear blocks 11, 12 together. In this example the holes 17 extend right through the front block 11 and right through the rear block 12, and are not threaded.

The surfaces of each rim 15, 16 also each have a groove 18 extending all the way around the respective rim 15, 16. The grooves 18 accommodate a seal 31 (shown in FIG. 3). In this embodiment the seal 31 is a rectangular O-ring seal, but in other embodiments the seal 31 can be any material that is relatively deformable in comparison to the blocks 11, 12. When the blocks 11, 12 are brought together, the seal 31 deforms. The bolts 30 are passed through the holes 17 and screwed onto nuts 32 at the opposite end of the holes 17, and the nuts 32 and bolts 30 are tightened to put the side walls 14*a* and 14*b* under compression. There is metal to metal contact between the rims 15 and 16, and the seal 31 is compressed into the grooves 18, but the seal 31 ensures an air-tight closure between the rims 15, 16.

In the front block 11, an opening 19 communicates between the recess 13*a* and an outer, front surface of the front block 11. A speaker driver (not shown) is mounted in the opening 19, facing out from the cavity formed by the recesses 13*a* and 13*b*. The volume of the cavity formed by the recesses 13*a* and 13*b* is matched to the loudspeaker driver, in accordance with the manufacturers recommendations. It may also be desirable to ensure that the surfaces within the cavity are smooth, by machining off any jagged edges. The rear wall of the cavity is formed by the rear wall of the rear block 12, and this is sufficiently thick (for example at least 2.5 mm thick, and more preferably at least 5 mm thick) to be substantially rigid. Since the cavity in this example is to be airtight, any holes through which electrical wires extend to the speaker driver must subsequently be sealed for example with a hard filler, or an epoxy resin.

In a modification, the holes 17 in the rear block 12 are as described above, but the holes 17 in the front block 11 do not extend through to the front surface, so they are blind holes; and although they are not threaded at least through the greater portion of their length through the side walls 14*a*, there is a threaded portion adjacent to the blind end of the hole 17. Hence the nuts 32 are not required, and the bolts 30 can be inserted through the holes 17, to engage with the threaded portion adjacent to the blind end of the holes 17, and tightened up to put the side walls 14*a* and 14*b* under compression. As described above, in this state there is metal to metal contact between the rims 15 and 16, and the seal 31 is compressed into the grooves 18 while ensuring an air-tight closure between the rims 15, 16.

As shown, it is preferable to provide holes 17 with bolts 30 all around the periphery, for example at spacings of between 30 mm and 150 mm; the side walls 14*a* and 14*b* are sufficiently thick to accommodate these holes 17 as well as the groove 18 for the seal 31. It will be appreciated that the bolts 30 can therefore subject the side walls 14*a* and 14*b* to a considerable compressive load. For example a steel screw of metric size M3, with an effective cross-sectional area of about 5 $mm^2$, could provide a load of more than 3000 N; the compressive force on the side walls 14*a* and 14*b* in this case may be constrained by the strength of the aluminium.

Referring to FIGS. 4 to 8, according to a second embodiment, there is provided a loudspeaker 70 comprising multiple layers 40. Each layer 40 is substantially flat, and can be described as a sheet or lamina. It may be of any convenient solid material, for example metal, wood, or a wood-based material such as medium-density fibreboard (MDF), plywood, or even glass, plastic or paper. In one example each layer 40 is of MDF. In another example each layer 40 is of a plastic, for example polyethylene, or an engineering plastic such as acrylonitrile butadiene styrene (ABS), a polyamide (PA), polyoxymethylene (POM or acetal, sold as Delrin™) or polyether ether ketone (PEEK).

An opening 41 is provided in each layer 40. In this embodiment, the opening 41 is in the centre of each layer 40, but this is not essential. Holes 42 are also provided in each layer for receiving bolts 50.

Figure 7:
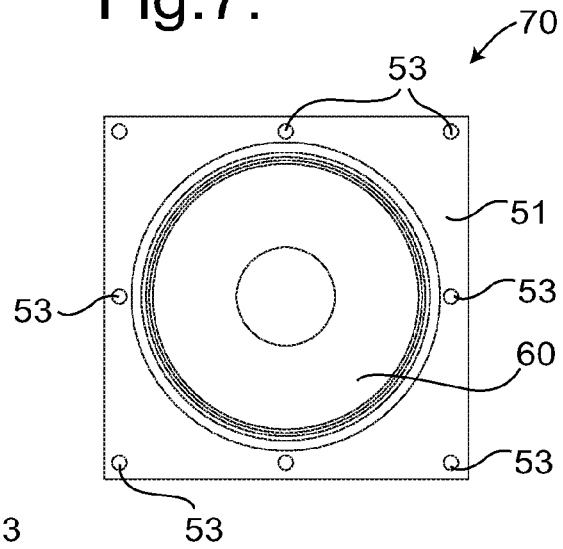
FIG. 7 is a schematic illustration of the loudspeaker according to the second embodiment, showing a front view of the loudspeaker housing with the loudspeaker driver.
Figure 8:
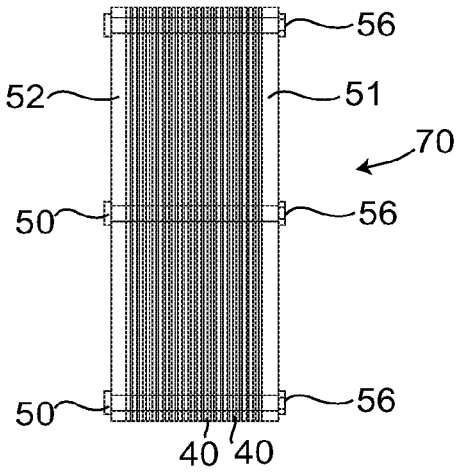
FIG. 8 is a schematic illustration of the loudspeaker according to the second embodiment, showing a side view of the loudspeaker housing.

The loudspeaker 70 has a front plate 51 and a rear plate 52 (see in particular FIG. 8). The front plate 51 and rear plate 52 may be stiffer than the layers 40, and in this embodiment thicker; however, in a modification the front plate 51 and the rear plate 52 are of the same material and the same thickness as the layers 40. Like the layers 40, the front and rear plates 51, 52 have holes 53 for the bolts 50. The front plate 51 has an opening 54 similar to that of the layers 40. The opening 54 of the front plate 51 is arranged to accommodate a loudspeaker driver 60 (shown in FIG. 7). The rear plate 52 does not have any such an opening, as it is positioned behind the loudspeaker driver 60, although it may have holes though which electrical connections to the loudspeaker driver 60 can be made; any such holes must subsequently be sealed, for example with a hard filler, or for example an epoxy resin, if the rear plate 52 is to be airtight.

Figure 6:
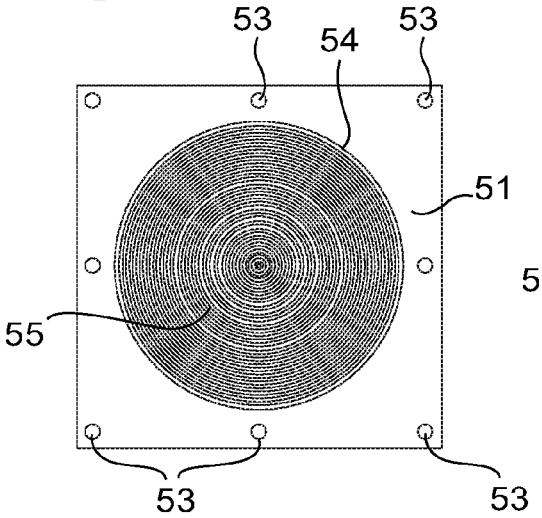
FIG. 6 is a schematic illustration of the loudspeaker according to the second embodiment, showing a front view of the loudspeaker housing without the loudspeaker driver.

As can be seen most clearly in FIG. 6, the openings 41, 54 in the layers 40 and the front plate 51 may have different sizes. More specifically, the openings 41 in this embodiment decrease in size in each successive layer 40, from the front plate 51 towards the rear plate 52. In this embodiment, the openings 41 are concentric circles. Moreover, the diameters of the openings 41 decrease in steps that increase in size towards the rear plate 52. This means that the openings 41, when the loudspeaker driver 60 is in position mounted on the front plate 51, provide a cavity 55 behind the loudspeaker driver 60 that is dome shaped. In a special case, the cavity 55 can be hemispherical.

The loudspeaker 70 is made by assembling the layers 40 as a stack, along with the rear plate 51 and the front plate 52, with the bolts 50 through the holes 42 and 53. The surface of the cavity 55 may then be machined to provide a smooth surface. The loudspeaker driver 60 is mounted within the opening 54 in the front plate 51. The bolts 50 are provided with nuts 56 (see FIG. 8), and these are tightened to ensure that the layers 40 are firmly clamped together so the side walls of the cavity 55 are under compression. An adhesive may also be provided between the successive layers 40; such an adhesive will ensure an airtight seal.

The dimensions of the openings 41 and 54 are selected to suit the loudspeaker driver 60. In particular the openings 41 must be of a size suitable to form a cavity 55 of a volume which is matched to the loudspeaker driver 60. In addition it will be appreciated that the cavity 55 is airtight, in this example.

In the embodiment described above in which the openings 41 become smaller towards the rear plate 52, the stiffness of the rear plate 52 is enhanced by the adjacent layers 40. In a modification in which the front plate 51 and the rear plate 52 are of the same material and thickness as the layers 40, the stiffness of the rear plate 52 (which does not have an opening corresponding to the openings 41) may be increased by providing more than one rear plate 52 sandwiched together.

In a modification, a somewhat simpler version defines a cylindrical cavity 55, in that all the openings 41 are of the same diameter. In an experimental test with such a simpler version made of thirteen layers 40 of MDF, the acoustic energy measured at 1 m achieved by a 10 W personal stereo speaker was found to increase from 82 dB up to 96 dB by mounting the speaker in this housing, and the acoustic fidelity was also enhanced.

Referring back to the embodiment shown in the figures, if both the front plate 51 and the rear plate 52 are of a comparatively strong material such as aluminium, and are sufficiently thick, then the heads of the bolts 50 and the nuts 56 may not require washers. The layers 40 may be of a comparatively less strong material, such as MDF, or other materials such as wood, paper, plastic or cloth, as they are under compression between the front plate 51 and the rear plate 52, which spread the force substantially uniformly over the region between adjacent bolts 50. If the front plate 51 and the rear plate 52 are of a less strong material, such as those mentioned as suitable for the layers 40, then washers may be provided for the heads of the bolts 50 and for the nuts 56, to spread the load and also to raise the compressive force to which the layers 40 may be subjected. If the front plate 51 is of a comparatively strong material such as aluminium, and is sufficiently thick, the nuts 56 may be omitted, and instead the bolts 50 may engage with threaded blind holes in the rear of the front plate 51. This may enhance the appearance of the front of the loudspeaker 70. However, to achieve large enough compressive forces it may be preferable, even with aluminium end plates 51 and 52, to provide steel nuts 56 and steel bolts 50; and the end plates 51 and 52 may be provided with recesses to accommodate the head of the bolt 50 and the nuts 56, to improve the appearance of the housing.

During assembly, as the bolts 50 are tightened, if you tap on the sidewall the tone of the resulting noise provides a clear indication as to when an adequate compressive force has been achieved as the tone will change from a dull knock to a much higher pitched note. The amount of compressive force required depends on the material of the layers 40, the depth of the housing (between the end plates 51 and 52) and the thickness of the side walls of the resulting cavity 55.

The force, F, exerted by a bolt of thread diameter d and pitch P, with a mean diameter D of the nut, may be related to the applied torque T by an equation of the form:

$$T=F\cdot\{(0.159\times P)+(0.577\times d\times\mu_1)+(0.5\times D\times\mu_2)\}$$

where $\mu_1$ is the coefficient of friction at the thread, and $\mu_2$ the coefficient of friction between the head and the surface. However, this can only give an approximate value for the force, F, as the values of the coefficients of friction are not known accurately; and as a general rule the proportion of the torque required to overcome these frictional effects is about 85% to 90%. Nevertheless it remains true that, if the other parameters remain constant, the force F increases as the torque T increases.

For example with stainless steel M6 bolts and 10 mm washers applied directly to a stack of layers of birch ply, 150 mm high, the washer was found to deform the plywood at T=1 N.m, and when T=3 N.m the washer had sunk into the plywood. It was not possible to achieve sufficient compression to achieve a rigid structure, because the washer merely sank further into the plywood. In contrast, with layers 40 of plywood or MDF clamped between 10 mm thick aluminium end plates 51, 52, and a total depth of the laminated structure of 145 mm, the required torque for a rigid state was T=5 N.m.

In another example, a loudspeaker 70 was in the form of a 54 liter enclosure with a 255 mm compressed depth in between two aluminium plates. The sides were formed of successive layers of beech wood ply, each 15 mm thick, using thirty-six M6 bolts. Resonance was monitored by observing a penny resting on the top wall of the loudspeaker 70. The loudspeaker driver was actuated with a sinusoidal signal, and the sound level was static at 116 dB.

A full frequency sweep was carried out, first without compression. The resonant frequency was identified as 250 Hz (at which the penny danced around on the top wall). Then, holding the frequency constant, the bolts were tightened. The observed results were as follows:

2 N.m of torque applied on every bolt the enclosure resonated violently;

5 N.m, the amount of resonance was reduced by around 10-15%;

8 N.m the resonance had disappeared.

Then, another frequency sweep was carried out (without changing the 8 N.m of torque applied), and it was discovered that at 500 Hz there was a small amount of resonance. The torque was then gradually increased, and at 15 N.m it was found that the 500 Hz resonance also disappeared.

Another frequency sweep was carried out at 15 N.m torque, and uniform vibration of the enclosure was observed at every frequency, without any resonance. It should be noted that without the provision of the aluminium plates, a torque as little as 2 N.m would have caused significant damage to the outer sheets of plywood, because the bolt head would sink in.

Typically the bolts 50 are spaced apart at spacings that are between 50 mm and 150 mm, and the aluminium end plate must be sufficiently rigid to spread the compression load over the region between successive bolts 50. In one example the bolts are at 85 mm separation. It has also been observed that the required torque increases as the total depth of the laminated structure increases. For example in one experiment, using M8 bolts, where the depth was 300 mm, the required torque was T=10 N.m (applied to 36 bolts at 85 mm spacing, and with aluminium end plates of thickness 15 mm); where the depth was 600 mm, the required torque was T=20 N.m, and where the depth was 1200 mm, the required torque was T=40 N.m.

The size of the bolts is also affected by the size of the loudspeaker. For example the loudspeaker 70 might be less than 35 mm from front to back, with side walls of thickness no more than 3 mm, and in this case it would be appropriate to use M1 or M2 bolts. In one example the layers 40 are of aluminium or of plastic, each of thickness 0.1 mm or 0.2 mm, between front and rear plates 51 and 52 that are of aluminium or zinc and of thickness 1 mm or 2 mm. With such thin sidewalls the applied compressive force is essential, as such thin walls have a greater tendency to resonate. In another application the loudspeaker 70 might be very much larger, for example more than 1 m between the front and rear plates 51 and 52, and with wall thicknesses which may be more than 35 mm, for example 50 mm; and in such a large loudspeaker 70 the bolts 50 might be M10 or M12 order to obtain sufficient compressive force to suppress vibrations at lower frequencies.

As a further modification, the openings 41 may not all be aligned. Furthermore the opening 54 in the front plate 51 must be of a size to accommodate the speaker driver 60, but the openings 41 in the layers 40 may be larger, or those in the layers 40 closer to the rear plate 52 might be larger; this may enable a larger cavity volume to be provided within a smaller overall depth. An equivalent arrangement is described below in relation to FIG. 17.

Figure 5A:
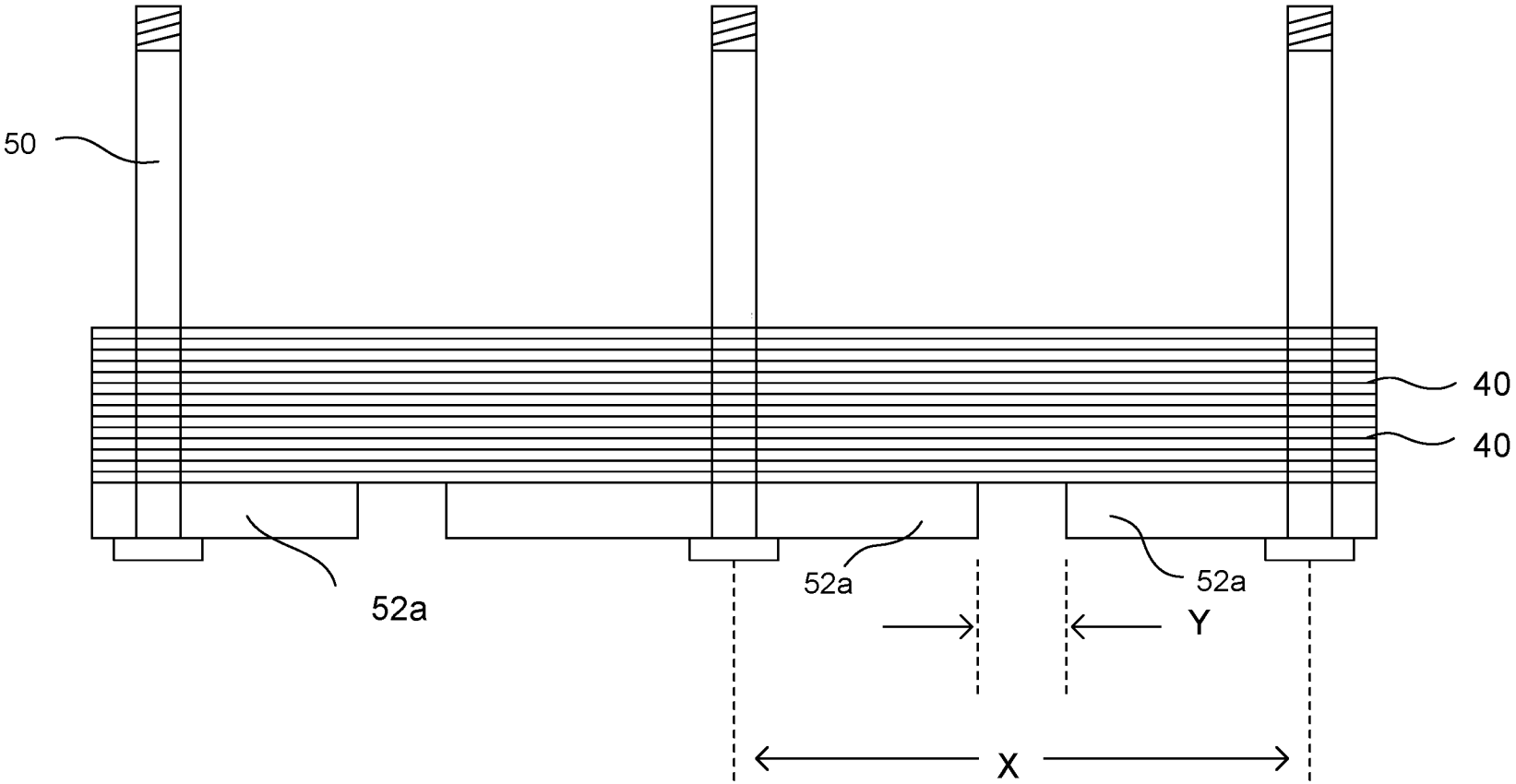
FIG. 5*a* is a schematic illustration of an alternative to the second embodiments shown in FIG. 5.

FIG. 5*a* shows an embodiment in which a plurality of washers 52*a* are employed in a place of an end plate (in this case, in place of rear plate 52). Each of the washers 52*a* serve the "force-spreading" purpose served by the end plates in the other embodiments. As can be seen, each bolt 50 has a respective washer 54*a* associated with it. The washers 52*a* (e.g., see the centrally-located washer 52*a* ) can be seen to have a width or diameter that is sufficiently large so that a gap Y formed between adjacent washers 52*a* has a magnitude that is no more than 20% of the distance between the adjacent compressing members (in this case, bolts 50), which is designated in FIG. 5*a* as X.

Figure 9:
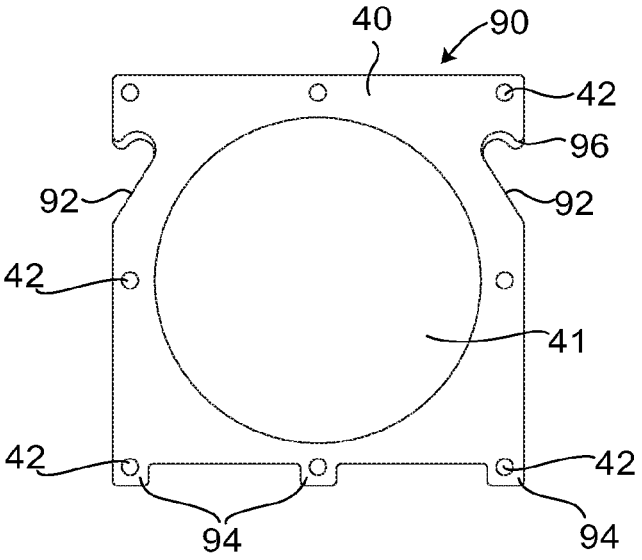
FIG. 9 is a schematic illustration of a loudspeaker according to a third embodiment, showing a front view of a layer of a loudspeaker housing.

Referring now to FIG. 9, according to a third embodiment, there is provided a loudspeaker 90 similar to that of the second embodiment, except that at least some of the layers 40 have cut-outs 92 on either side. The cut-outs 92 are positioned on the sides of the layers 40 that are on upright sides of the loudspeaker when oriented in normal use. Each cut-out 92 overlaps that on the layers 40 adjacent to it, such that the cut-outs 92 together form recesses on the sides of the loudspeaker housing. When assembled into a stack and bolted together, as described above in relation to the loudspeaker 70, the cut-outs 92 together define recesses in the side walls, the recesses facing downwardly to provide handles by which the loudspeaker 90 can be picked up. These recesses may be provided with a resilient liner 96 so the resultant handles are more comfortable to hold.

Similarly, at least some of the layers 40 of the loudspeaker 90 also have protrusions 94 on a bottom edge. When the layers 40 are assembled into a stack and bolted and compressed together, as described above, these protrusions 94 define feet for the loudspeaker 90.

Figure 10:
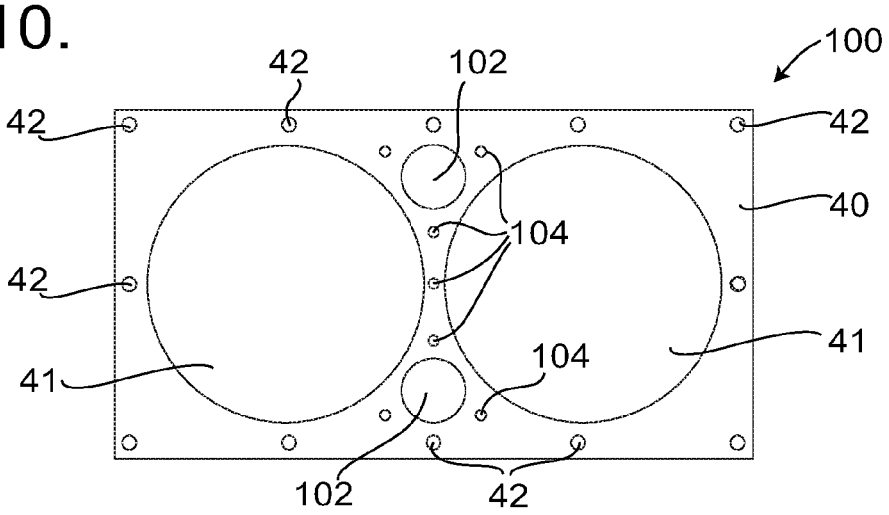
FIG. 10 is a schematic illustration of a loudspeaker according to a fourth embodiment, showing a front view of a layer of a loudspeaker housing.

Referring now to FIG. 10, according to a fourth embodiment, there is provided a loudspeaker 100 similar to that of the second embodiment, except that the layers 40 have two openings 41, so as to provide two cavities for two loudspeaker drivers 60. At least some of the layers 40 also have smaller additional openings 102 for smaller loudspeaker drivers. To ensure the side walls of all the resultant cavities are under compression, not only are there holes 42 around the periphery, but there are additional holes 104 in the webs that separate the openings 41 and the openings 102. When assembled, bolts 50 through the holes 42 and 102 compress the side walls. In an alternative, the smaller openings 102 may communicate within the stack with the openings 41, so that the openings 102 act as ports.

Figure 11:
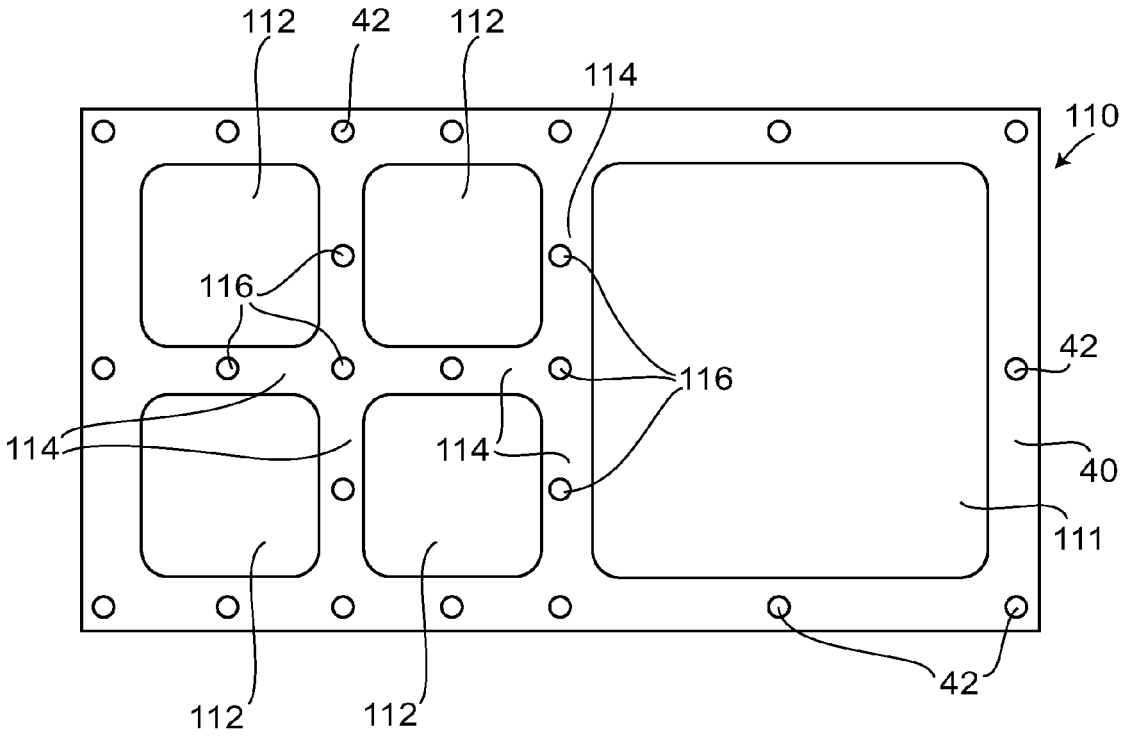
FIG. 11 is a schematic illustration of a loudspeaker according to a fifth embodiment, showing a front view of a layer of a loudspeaker housing.

Referring to FIG. 11, according to a fifth embodiment, there is provided a loudspeaker 110 similar to that of the second embodiment, except openings 111, 112 of different sizes are provided in each layer 40, so as to provide cavities of different sizes for different loudspeaker drivers. In this embodiment the cutting out of the four smaller openings 112 and the larger opening 111 leaves internal struts, corresponding to side walls 114 of the respective cavities. To ensure that all these side walls 114 are held under compression, the layers 40 are provided with additional holes 116 for bolts 50, in addition to the holes 42 around the periphery, so when assembled the bolts 50 compress the walls of all the openings 111 and 112.

Figure 12:
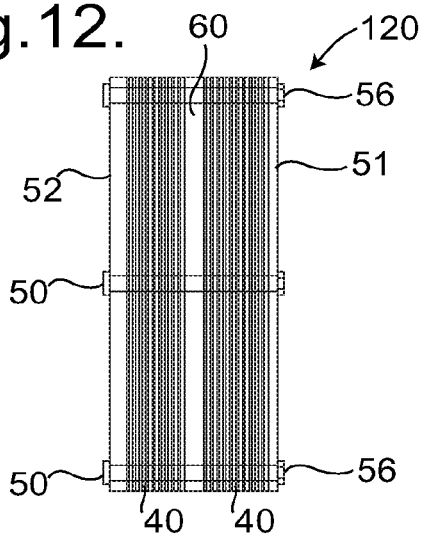
FIG. 12 is a schematic illustration of a loudspeaker according to a sixth embodiment, showing a side view of a loudspeaker housing.

Referring to FIG. 12, according to a sixth embodiment, there is provided a loudspeaker 120 similar to that of the second embodiment, except the loudspeaker driver 60 is mounted with layers 40 both in front and behind it. The layers 40 behind the loudspeaker driver 60 provide a cavity 55 behind the loudspeaker driver 60, as in the loudspeaker 70, while the layers 40 in front of the loudspeaker driver 60 provide a channel or horn for sound produced by the loudspeaker driver 60.

In a modification to the embodiment of FIG. 12, a loudspeaker 70 may be provided with a separate channel or horn-defining module in front of the loudspeaker driver 60. Such a separate channel or horn-defining module may be constructed in a different way to the loudspeaker 70. For example it might be constructed of a stack of plates, each plate with a cut-out to define part of the channel or horn, and bolted together, but with the plates in a plane orthogonal to those forming the loudspeaker 70.

Figure 13:
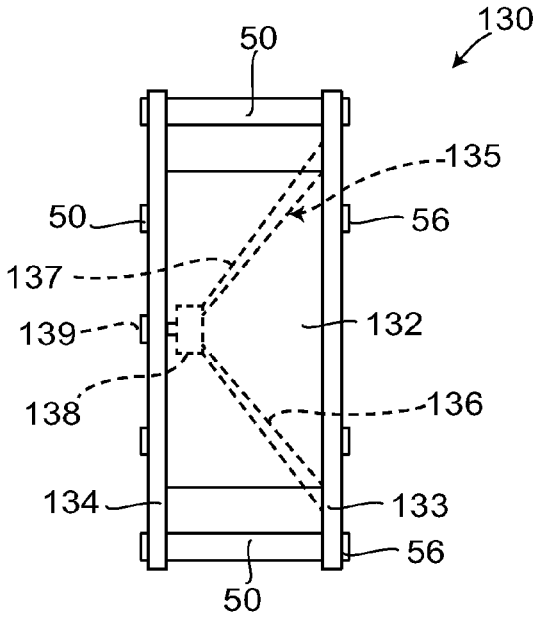
FIG. 13 is a side view of a loudspeaker according to a seventh embodiment.

Referring now to FIG. 13 there is shown a side view of a seventh embodiment, showing a loudspeaker 130. This comprises a hollow cylinder 132 between a front plate 133 and a rear plate 134. The front plate 133, like the front plate 51, defines an opening in which a loudspeaker driver 135 (indicated in broken lines) can be mounted; the rear plate 134, like the rear plate 52, does not provide any such opening. Both the front plate 133 and the rear plate 134 are of a rigid material, for example they may be of aluminium, and of thickness between 5 and 10 mm. The hollow cylinder 132 is of a length and diameter selected so as to define a cavity behind the loudspeaker driver whose volume is matched to the loudspeaker driver 135. The hollow cylinder 132 may for example be of aluminium, or of wood, and the wall thickness might also be between 5 and 10 mm by way of example. The front plate 133 and the rear plate 134 are held together by bolts 50 and nuts 56, and these are tightened up sufficiently to ensure that the walls of the hollow cylinder 132 are under compression. If the cavity behind the loudspeaker driver is to be airtight, an O-ring may be provided within a groove in each end face of the hollow cylinder 132, or the end faces of the hollow cylinder 132 may be sealed by adhesive to the front plate 133 and the rear plate 134.

The rear plate 134 may additionally be compressed by bolts (not shown) through its thickness, to maintain the material of the rear plate 134 under compression.

The loudspeaker driver 135, as is conventional, includes a movable cone 136 supported at its periphery by a conical frame 137, and a magnet 138 (represented diagrammatically). In a further modification, which would be applicable in the loudspeaker 130 and would also be applicable in other designs of loudspeaker, the magnet 138 is attached by a bolt 139 to the rear plate 134. This further suppresses the risk of unwanted vibrations, and is applicable in all the loudspeaker embodiments, in particular those that are of a laminated structure, for example in the loudspeaker 70, or the loudspeaker 90, or the loudspeaker 100.

In the loudspeaker 130 the bolts 50 are shown as being arranged outside the hollow cylinder 132, but in an alternative the bolts 50 might extend through lengthwise unthreaded holes within the wall of the hollow cylinder 132. It will also be appreciated that instead of using nuts 156, the bolts 50 might instead engage with threaded holes in the front plate 133.

Figure 14:
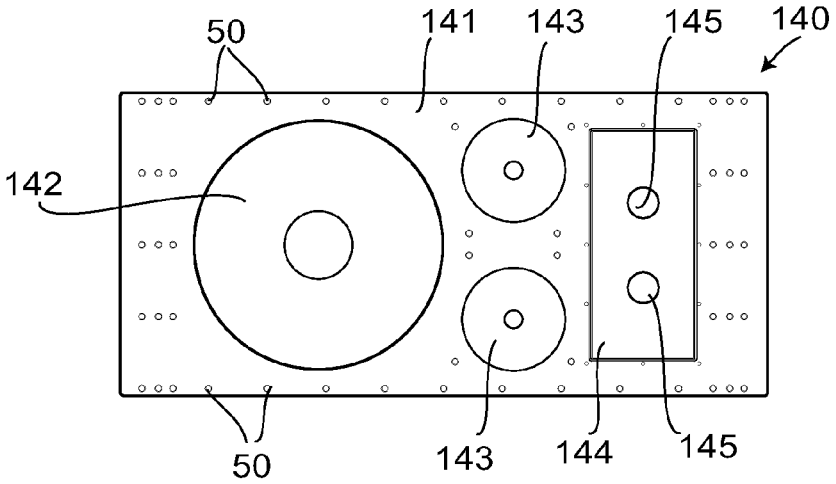
FIG. 14 is a plan view of a front plate of a loudspeaker according to an eighth embodiment.
Figure 15:
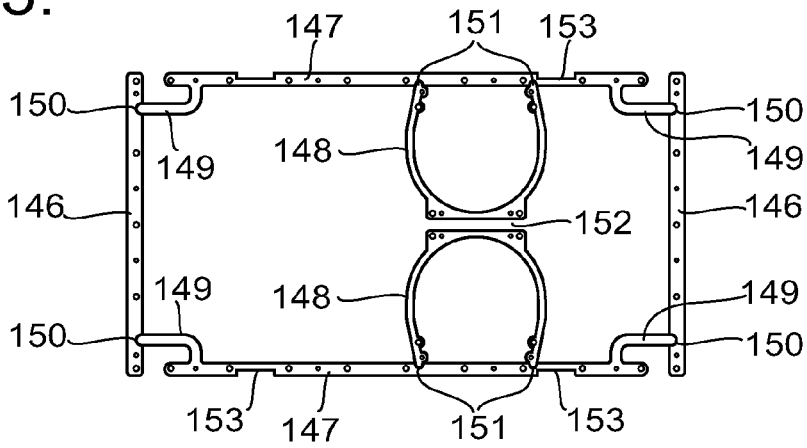
FIG. 15 is a plan view of a layer of the loudspeaker housing of the loudspeaker of the eighth embodiment.

Referring now to FIGS. 14 and 15, there is shown a loudspeaker 140, which, like the loudspeakers 70, 100 and 110, is of laminated structure, with a stack of layers between a front plate 141 and a rear plate, which are clamped together by bolts 50. As shown in FIG. 14, the front plate 141 defines a large aperture that locates a low-mid frequency driver 142, which may for example be of diameter 380 mm; two smaller apertures that locate high-mid frequency drivers 143, which may for example be of diameter 150 mm; and a rectangular aperture carrying a plate 144 which carries two 25 mm diameter compression drivers 145 for high frequencies. The compression drivers 145 have an enclosed rear face.

The rear plate (not shown) is of the same rectangular shape as the front plate 141, but does not define any apertures. To ensure it is sufficiently rigid, both the front plate 141 and the rear plate are of aluminium, of thickness 15 mm or 20 mm.

As shown in FIG. 15, each layer is made up of six flat strips: two side strips 146, front and rear strips 147, and horseshoe-shaped strips 148. The top and bottom strips 147 include J-shaped inward projections 149 which locate into corresponding notches 150 in the side strips 146, so as to form a closed generally-rectangular space. The ends of the horseshoe-shaped strips 148 locate in notches 151 in the top and bottom strips 148, so as to define generally cylindrical cavities behind the high-mid frequency drivers 143. There is a gap 152 between the horseshoe-shaped strips 148, so the space behind the low-mid frequency driver 142 can communicate through the gap 152 with the space behind the compression drivers 145.

As previously described, these components are clamped together by the bolts 50, so that the stacked layers (consisting of the strips 146, 147 and 148) are under compression. The J-shaped inward projections 149 provide handles on each side of the loudspeaker 140, both on the top and the bottom. The top and bottom strips 147, in this example, each define two rectangular recesses 153, which define rectangular slots in the assembled loudspeaker 140. A rubber strip (not shown) may be fixed in these slots 153, for example in the slots 153 on the bottom of the loudspeaker 140, projecting slightly below the bottom of the loudspeaker 140 to act as feet. If two such loudspeakers 140 are stacked on top of each other, the rubber strips on the upper loudspeaker 140 would then fit into the corresponding slots 153 on the top of the lower loudspeaker 140.

Figure 4:
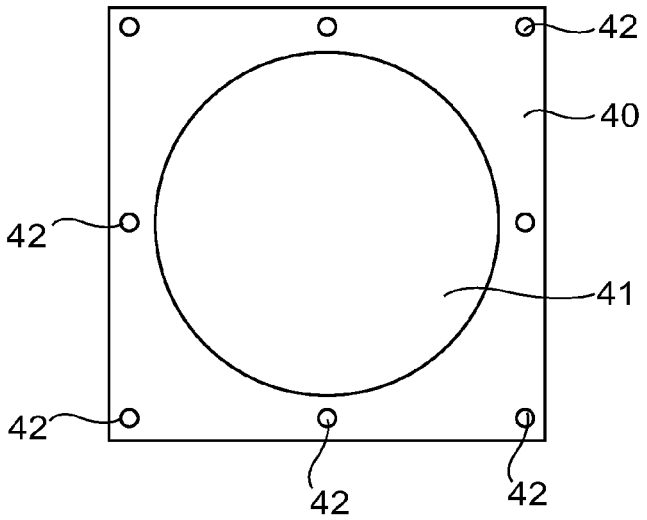
FIG. 4 is a schematic illustration of a loudspeaker according to a second embodiment, showing a front view of a layer of a loudspeaker housing.
Figure 5:
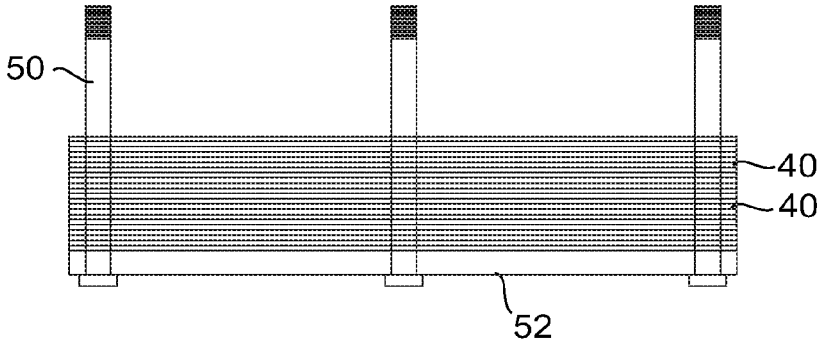
FIG. 5 is schematic illustration of the loudspeaker according to the second embodiment, showing a side view of the loudspeaker housing during assembly.
Figure 16:
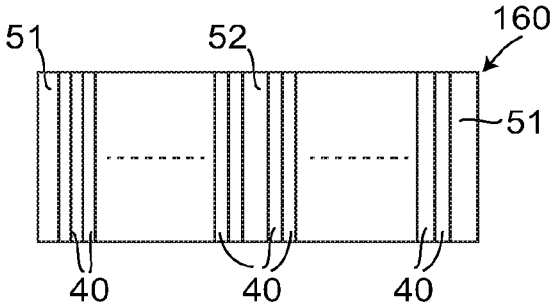
FIG. 16 is a side view of a loudspeaker of a ninth embodiment.

Referring now to FIG. 16 there is shown a loudspeaker 160 which is a modification of the loudspeaker 70. It comprises two front plates 51, one at each end, and a rear plate 52 in the middle. These are spaced apart by several layers 40, which may define identical apertures, for example circular apertures as shown in FIG. 4. All the layers 40 are clamped together and held under compression by bolts 50 (not shown in FIG. 16). Each front plate 51 has an opening 54 arranged to accommodate a loudspeaker driver 60 as shown in FIG. 7. The rear plate 52 does not have any such an opening, as it is positioned behind the loudspeaker drivers 60.

In use, both the loudspeaker drivers 60 may be supplied with the same signals, for example as a bass loudspeaker. This has the effect that the drivers 60 would generate equal and opposite forces on the rear plate 52, which is therefore subjected to no resultant force. This would further suppress resonance.

Figure 17:
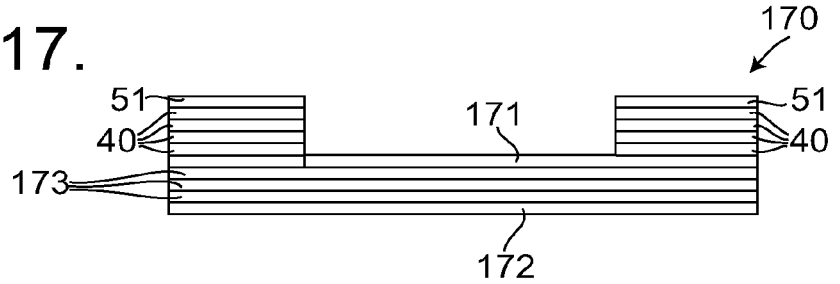
FIG. 17 is a side view of a loudspeaker of a tenth embodiment.

Referring now to FIG. 17 there is shown a loudspeaker 170 which is an alternative modification of the loudspeaker 70. It comprises two front plates 51, one blank front plate 171 and one blank rear plate 172. By way of example each front plate 51 may be square, 150 mm×150 mm, while the blank rear plate 172 may be rectangular, 150 mm×750 mm. Immediately adjacent to each front plate 51 are a stack of layers 40, which may define identical apertures, for example circular apertures as shown in FIG. 4. These stacks of layers 40 are at opposite ends of the loudspeaker 170. The blank front plate 171 covers the front face of the loudspeaker 170 between the stacks of layers 40, and extends under one of the stacks (the right-hand stack as shown). Hence the right-hand stack (as shown) of layers 40 defines a small cylindrical cavity, with part of the blank front plate 171 acting as the rear plate of the cavity. The front plate 51 on the right-hand stack (as shown) then includes a high/mid frequency driver, matched to the volume of the small cylindrical cavity.

The loudspeaker 170 also includes a stack of layers 173 of the same size as the blank rear plate 172, which define large rectangular apertures. These apertures communicate with the circular apertures in the layers 40 of the left-hand stack (as shown). The front plate 51 on the left-hand stack (as shown) includes a mid/low frequency driver, matched to the volume of the cavity defined by both the circular apertures in the layers 40 of the left-hand stack and the rectangular apertures in the layers 173. All the layers 40 and 173 are held and compressed together by bolts 50 (as shown in FIG. 8) between the front plates 51 and the blank rear plate 172, and between the exposed portion of the blank front plate 171 and the blank rear plate 172.

As discussed above, the layers 40 and 173 may be of a comparatively low density and comparatively weak material such as MDF or plywood, whereas the front plates 51, the blank front plate 171 and the blank rear plate 172 are of a more rigid material, such as aluminium of thickness for example 10 mm or 15 mm (a plate of thickness 5 mm was not found to be satisfactory in this application). The bolts 50 subject the walls of the cavities to sufficient compressive force that they are substantially rigid. The bolts 50 are sufficiently close together, and the end plates are sufficiently rigid, that the compressive force on the layers 40 and 173 is substantially uniform. By way of example the bolts 50 may be stainless steel M6 bolts, of diameter 6 mm, which is satisfactory when applying a torque T=10 N.m; or may be M8 bolts, of diameter 8 mm, which is satisfactory when applying a larger torque such as T=30 N.m.

It will be appreciated that the embodiment of FIGS. 4-8, and the embodiments of FIGS. 9-12 and 14-17 may all be described as being of a laminated structure, with the sheets or laminae in planes that are orthogonal to the direction of movement induced by the loudspeaker driver. Such a structure can provide cost benefits, even without providing a compressive force using the bolts 50. The structure may be made of comparatively cheap materials such as MDF, plywood, or even card or paper; and the successive layers 40 can be simply cut out and stacked and bonded together. External pressure to compress the layers 40 together may be applied during the bonding procedure; and released once the layers are bonded. The material may be recycled material.

The provision of compressive force, for example using the bolts 50, enables a rigid structure to be constructed while using comparatively low density materials. For example MDF has a density of less than 1000 kg/m$^3$, but its rigidity can be very considerably enhanced by the construction method described above. Hence the weight of the resulting housing can be reduced as compared to conventional construction methods that provide equivalent rigidity. The rigid structure of the housing improves the quality of the sound emitted in the case of a loudspeaker, or the fidelity with which a microphone would pick up sounds. In each case in which bolts are used, the bolt heads and the nuts may be provided with washers to spread the load, as this may enable a greater compressive force to be applied.

The force exerted by one of the bolts 50 can be estimated from the compression of the layers 40 that is achieved. In one example a large rectangular loudspeaker has external dimensions of 790 mm by 422 mm, and includes a stack of 17 mm thick birch plywood layers, defining a peripheral wall thickness 16 mm for a rectangular cavity. The height of the stack is 240 mm. There are thirty M8 bolts around the periphery. It was observed that when the bolts 50 were sufficiently tight to prevent resonance, the height of the stack was reduced by 1.7 mm. Hence:

strain=1.7/240=0.00708
stress=14.17 MPa (assuming Young's modulus is 2 GPa)
total force=550 kN=55 tonnes force
bolt load=1800 kgf In another example, a rectangular loudspeaker has external dimensions of 600 mm by 430 mm, with a wall thickness of 20 mm and a wall height of 145 mm. There are twenty-eight M8 bolts around the periphery. It was observed that when the bolts 50 were sufficiently tight to prevent resonance, the height of the stack was reduced by 1.45 mm. Hence:

strain=1.45/145=0.01
stress=20 MPa (assuming Young's modulus is 2 GPa)
total force=824 kN=82 tonnes force
bolt load=2900 kgf It should be appreciated that these are estimates, because the modulus of elasticity of this birch plywood is not known precisely. Nevertheless these values of bolt load are indicative of the large force required to achieve adequate compression of a large loudspeaker, which is considerably greater than is required merely to hold the layers tightly together.

As previously mentioned, the load produced by a bolt 50 must be sufficient to prevent resonance, and is significantly greater than is achieved merely by "tightening" the bolt. By way of example, with the large rectangular loudspeaker described in the preceding paragraph, the M8 bolts 50 were "tight" with a torque of about 2 N.m, but the torque required to achieve adequate compression was 25 N.m. Similarly, with the loudspeaker 10 of FIG. 1, in which the structure is entirely of aluminium, nylock nuts on M8 bolts 30 were "tight" with a torque of about 15 N.m, whereas adequate compression was achieved at 25 N.m.

It is expected that housings made in accordance with the present invention would have a wide range of different applications, for example they may be used for loudspeakers of any type, size, or frequency range, from the very small to the very large, for application in a wide range of different fields including professional audio, home audio, portable audio, headphones, laptops, mobile phones. Other loudspeaker fields where benefits would be provided may include the following: Automotive—rigid shapes could be made to fit within specific or restricted spaces, to improve car audio quality, without any cost penalty. These devices could also be thinner and at the same time improve sound quality, and reduce weight and cost. Aircraft—this would improve aircraft sound systems both in quality and reduced weight. Industrial and public space—large high-power loudspeakers may be improved in sound quality and longevity, with reduced manufacturing cost. Laptops, television and portable entertainment devices—low cost manufacture with increased sound quality and reduced weight. Boats—problems from water and salt may be reduced by appropriate selection of materials. Fire and burglar alarms and evacuation speakers—fire proof and heat resistant material could be used to produce a fire resistant and tamper proof loudspeaker.

The invention also has application in a range of other devices. For example: Microphones—better containment will stop unwanted interference from the structure and aid directionality, allowing for a more accurate signal to be recorded. Airport bird control and general animal control—ultrasonic devices that are above human hearing could benefit from increased intensity. Ultrasonic—medical devices such as scanners for unborn children could benefit from increased sensitivity. Sonar—Ships and submarines could benefit from the containment offered by this technology, as less energy would travel through the boat or submarine structure meaning less interference. Flaw detection—devices that send waves through structures may be of enhanced sensitivity.

Drivers

Referring to FIGS. 18 and 18*a* to 18*c*, according to a first driver embodiment there is provided a loudspeaker driver 210 comprising a front plate 211 and a rear plate 212, and multiple side elements 213. Each side element 213, as seen in FIG. 18*b*, is a flat ring or annulus, and may be described as a sheet or lamina. It may be of any convenient solid material such as metal, wood, or a wood-based material such as medium-density fibreboard (MDF), or even glass, plastic or paper. In one example each side element 213 is of MDF. Holes 214 are also provided in each side element 213 for receiving bolts 215.

The front plate 211 may be of a different material to the side elements 213, in particular a stiffer material, for example it may be of aluminium. The front plate 211 is also in the form of a flat ring or annulus, and is arranged to support the periphery of a driver cone 216. The rear plate 212 may also be of a different material to the side elements 213, in particular a stiffer material, for example it may be of aluminium. It is a sheet in the form of a wide ring, defining a circular central aperture 218 and multiple radial rows of smaller apertures 220. The rear plate 212, the side elements 213, and the front plate 211 are stacked together, and held together by several bolts 215 spaced equally around the periphery, extending through corresponding holes 214, with corresponding nuts 221. The nuts 221 and the bolts 215 are sufficiently tight to ensure that the side elements 213 are under compressive force.

The driver cone 216, as mentioned above, is mounted around its periphery to the front plate 211, and extends through the cylindrical chamber defined by the side elements 213, with a driver coil projecting through the central aperture 218. A magnet 222 is mounted on the rear of the rear plate 212, which interacts with an electric current in the driver coil to cause the cone 216 to oscillate, as is conventional. The space between the rear of the cone 216 and the side elements 213 is vented at the rear of the loudspeaker driver 210 by the apertures 220. Consequently oscillation of the cone 216 does not generate significant pressure fluctuations behind the cone 216.

Figure 19:
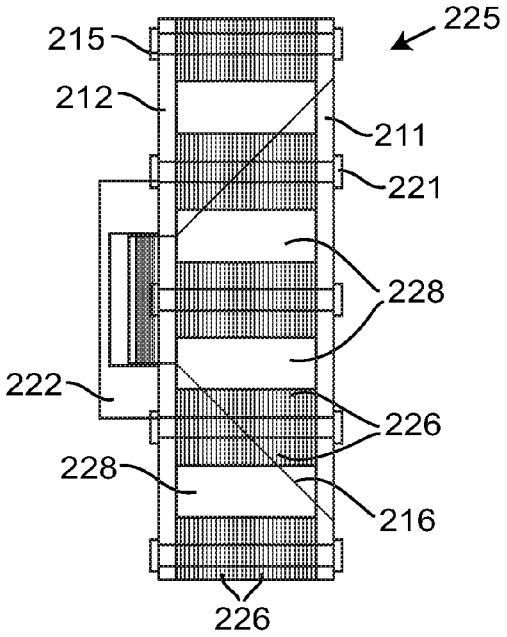
FIG. 19 shows a side view of a modification to the loudspeaker driver of FIG. 18.
Figure 19A:
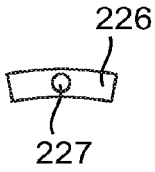
FIG. 19*a* shows a plan view of an element forming a sidewall of the loudspeaker driver of FIG. 19.

Referring to FIG. 19 there is shown a loudspeaker driver 225 which is a modification of the loudspeaker driver 210, those features which are identical being referred to by the same reference numerals. The loudspeaker driver 225 comprises a front plate 211 and a rear plate 212, which are held apart by multiple side elements 226. Each side element 226, as seen in FIG. 19*a*, is a short arcuate sheet element, which may be envisaged as a part of the side elements 213 of FIG. 1, and may be of any convenient solid material such as metal, wood, or a wood-based material such as medium-density fibreboard (MDF), or even glass, plastic or paper. In one example each side element 226 is of MDF. Holes 227 are also provided in each side element 226 for receiving the bolts 215.

The driver cone 216 is mounted around its periphery to the front plate 211, and extends through the cylindrical chamber defined by the side elements 226, with a driver coil projecting through the central aperture 218. A magnet 222 is mounted on the rear of the rear plate 212, which interacts with an electric current in the driver coil to cause the cone 216 to oscillate, as is conventional.

The rear plate 212, the side elements 226, and the front plate 211 are held together by the bolts 215 spaced equally around the periphery, extending through corresponding holes 214, with corresponding nuts 221. The nuts 221 and the bolts 215 are sufficiently tight to ensure that the side elements 226 are under compressive force. In the loudspeaker driver 225 there are gaps or slots 228 around the periphery of the sidewall, between successive side elements 226, which enhances the extent to which the space behind the cone 216 is vented.

In a modification to the loudspeaker drivers 210 and 225, the nuts 221 are not provided, but instead the holes 214 in the front plate 211 are threaded, so the bolts 215 engage directly the threaded holes 214 in the front plate 211. In a modification to the driver 225, the front plate 211 and the rear plate 212 are spaced apart by stacks of circular flat metal washers (not shown) in place of the arcuate side elements 226. In another modification to the driver 225, the rear plate 212 may not be provided with the small apertures 220, because sufficient venting is provided by the gaps or slots 228 around the periphery of the sidewall.

Figure 20:
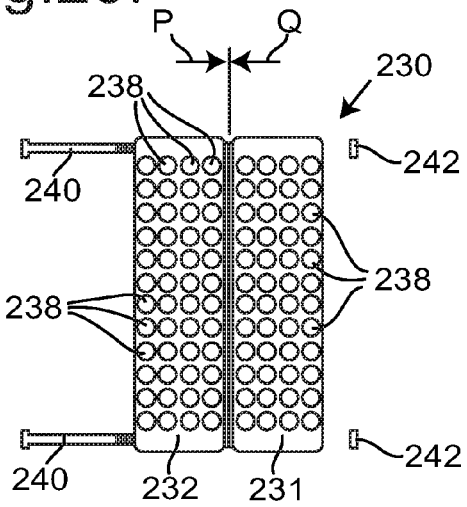
FIG. 20 shows a side view of a loudspeaker driver according to a second driver embodiment, prior to insertion of bolts.
Figure 20A:
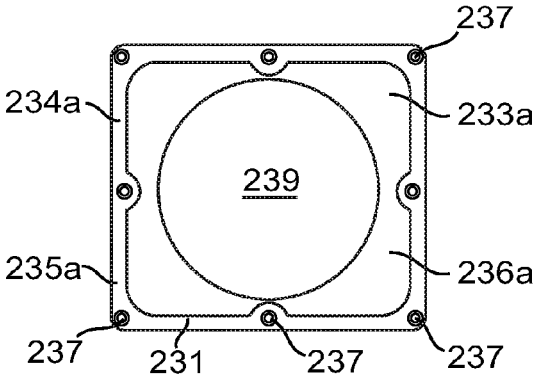
FIG. 20*a* shows a view corresponding to that on the line P-P prior to assembly.
Figure 20B:
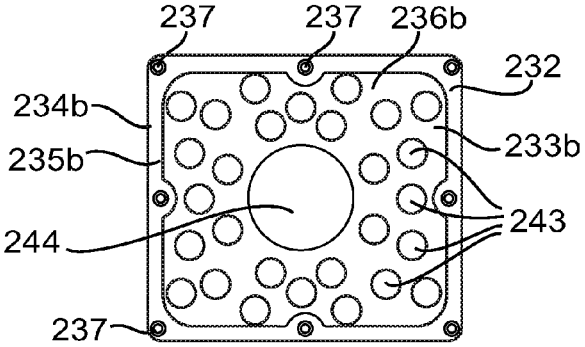
FIG. 20*b* shows a view corresponding to that on the line Q-Q prior to assembly.

Referring now to FIG. 20, and FIGS. 20*a* and 20*b*, an alternative loudspeaker driver 230 is in the form of a rectangular box, consisting of a front block 231 and a rear block 232 each shaped like an open box, defining a recess 233*a*, 233*b* enclosed by a side wall 234*a*, 234*b* and by an integral end plate 236*a*, 236*b*. The side walls 234*a* and 234*b* define flat rims 235*a*, 235*b*. In one example the front block 231 and the rear block 232 are of aluminium, and the side walls 234*a* and 234*b* are of thickness 10 mm.

The rim 235*a* of the front block 231 mirrors the rim 235*b* of the rear block 232, so the edges of the rims 235*a* and 235*b* align with one another, when the front and rear blocks 231, 232 are brought together. Each side wall 234*a* and 234*b* has holes 237 that extend from its surface, through the respective block 231, 232. Like the rims 235*a*, 235*b*, the holes 237 in the respective side walls 234*a* and 234*b* mirror one another, so when assembled, the holes 237 align so that bolts 240 can be inserted all the way through both the front and the rear blocks 231, 232 together. In this example the holes 237 extend right through the front block 231 and right through the rear block 232, and are not threaded. In addition, each side wall 234*a* and 234*b* defines multiple small apertures 238 through its thickness; the holes 237 and the small apertures 238 are arranged so they do not intersect.

The bolts 240 are passed through the holes 237 and screwed onto nuts 242 at the opposite end of the holes 237, and the nuts 242 and bolts 240 are tightened to put the side walls 234*a* and 234*b* under compression. There is metal to metal contact between the rims 235*a* and 235*b*.

In the front block 231, an opening 239 in the end plate 236*a* communicates with the outer, front surface of the front block 231. In the rear block 232, there are several small apertures 243 in the end plate 236*b* communicating with the outer, rear surface; and a magnet 244 is fixed to the centre of the end plate 236*b* within the recess 233*b*. A cone of a speaker driver (not shown) is mounted in the opening 239; the other end of the cone carries a coil which locates within the magnetic field of the magnet 244.

In use of the loudspeaker driver 230, electric current provided to the coil causes the cone to oscillate in the conventional fashion. The compression of the side walls 234*a* and 234*b* produced by the bolts 240 and the nuts 242 ensures that sideways vibrations of the side walls 234*a* and 234*b* are suppressed. The space behind the cone is vented both by the small apertures 238 through the side walls 234*a* and 234*b*, and also by the small apertures 243 in the end plate 236*b*. Consequently oscillation of the cone does not generate significant pressure fluctuations behind the cone.

In a modification, the holes 237 in the rear block 232 are as described above, but the holes 237 in the front block 231 do not extend through to the front surface, so they are blind holes; and although they are not threaded at least through the greater portion of their length through the side walls 234*a*, there is a threaded portion adjacent to the blind end of the hole 237. Hence the nuts 242 are not required, and the bolts 240 can be inserted through the holes 237, to engage with the threaded portion adjacent to the blind end of the holes 237, and tightened up to put the side walls 234*a* and 234*b* under compression.

As shown, it is preferable to provide holes 237 with bolts 240 all around the periphery, for example at spacings of between 30 mm and 150 mm; the side walls 234*a* and 234*b* are sufficiently thick to accommodate these holes 237. It will be appreciated that the bolts 240 can therefore subject the side walls 234*a* and 234*b* to a considerable compressive load. For example a steel screw of metric size M3, with an effective cross-sectional area of about 5 $mm^2$, could provide a load of more than 3000 N; the compressive force on the side walls 234*a* and 234*b* in this case may be constrained by the strength of the aluminium.

In a modification to the loudspeaker driver 230, apertures 243 and apertures 238 may be of a different shape to those shown in the drawings, for example slot shaped or square shaped. In a further modification there may be apertures only in part of the box provided by the front block 231 and the rear block 232, for example only in the side walls 234*a* of the front block 231, or only in the end plate 236*b* of the rear block 232. In each case such apertures may provide adequate venting.

In another modification, the box is sealed, so there are no apertures 238 in the side walls 234*a*, 234*b* and also no apertures 243 in the end plate 236*b* of the rear block 232. In this case the box defined by the front block 231 and the rear block 232 acts as a loudspeaker housing as well as a support frame for the loudspeaker cone and driver.

Loudspeaker and Driver

It will be appreciated that the concept of an integral loudspeaker housing and support frame is also applicable with a structure a stack of sheets, as in the loudspeaker drivers 210 and 225 of FIGS. 18 and 19.

Referring to FIGS. 21 and 21*a* to 21*e*, there is provided a loudspeaker unit 250 comprising a front plate 252, a support plate 253 and a rear plate 254, with multiple intervening layers 255 between the front plate 252 and the support plate 253, and multiple intervening layers 256 between the support plate 253 and the rear plate 254. Each of the intervening layers 255 and 256 is substantially flat, and can be described as a sheet or lamina. It may be of any convenient solid material, for example metal, wood, or a wood-based material such as medium-density fibreboard (MDF), or even glass, plastic or paper. In one example each layer 255 is of MDF. The front plate 252, the support plate 253, and the rear plate 254 may be of stiffer material, and for example may be of aluminium. Holes 257 are provided in every layer 255 and 256 and in each of the plates 252, 253 and 254, for bolts 260.

The loudspeaker unit 250 incorporates one low-frequency driver and four higher frequency drivers (not shown), each equivalent to the cone 216 and driver coil of the driver 210. The front plate 252 (see FIG. 21*a*) defines a large circular aperture 262 for the low-frequency driver, and four smaller circular apertures 264 for the higher frequency drivers. Each of the layers 255 (see FIG. 21*b*) defines a large square aperture 265 and four smaller square apertures 266, so when they are stacked together they define respective cavities that align with the apertures 262 and 264 in the front plate 252. The support plate 253 (see FIG. 21*c*) supports four small driver magnets 267, one within each cavity defined by the smaller square apertures 266, and supports a larger driver magnet 268 within the cavity defined by the large square apertures 265. The support plate 253 also defines four circular apertures 270 around the driver magnet 268.

Each of the layers 256 (see FIG. 4*d*) defines a S-shaped aperture 272 occupying most of the area of the layer 256 apart from the periphery, but with two projecting portions corresponding in part to the portions of the layers 255 that separate the smaller square apertures 266. This ensures that all the holes 257 are within the portion of the layer 256 that is not part of the aperture 272. The rear plate 254 (see FIG. 4*e*) defines holes 257 for the bolts 260, but does not define any other apertures. The S-shaped apertures 272 in the stack of layers 256 consequently defines a single cavity which communicates through the apertures 270 in the support plate 253 with the cavity defined by the large square apertures 262 in the layers 255.

The bolts 260 are inserted through the holes 257, and fixed with nuts 261. The bolts 260 are tightened sufficiently to ensure that the side walls of all the cavities defined by the apertures 265 and 266, and by the S-shaped apertures 272, are under compression. This suppresses any sideways vibration of those sidewalls.

Thus, in use, with driver cones mounted around their periphery in the apertures 262 and 264 of the front plate 252, the driver coils are correctly located relative to the respective magnets 267 and 268, so each loudspeaker driver operates effectively. The smaller cones are within the cavities defined by the apertures 266 in the layers 255, these cavities being enclosed, but in each case the cavity is sufficiently large relative to the size of the cone that pressure fluctuations are not detrimental to its operation. In contrast, the larger cone is within the cavity defined by the apertures 265 in the layers 255, and this cavity communicates with the cavity defined in the layers 256 by the S-shaped apertures 272. In combination, these cavities provide sufficient volume, relative to the size of the larger cone, that the oscillations of the cone are not detrimentally affected by changes in air pressure.

Hence the loudspeaker 250 provides the features of both the support frames for loudspeaker drivers, and also a housing for the loudspeakers. Since the bulk of the structure can be made of low-density material such as MDF, the overall mass of the loudspeaker 250 can be significantly less than with conventional loudspeakers.

As regards the cavities that accommodate the smaller cones, that is to say the cavities defined by the apertures 266, it will be appreciated that they may instead be of different sizes to each other; and that there might be a different number of such smaller cones and associated cavities, example two or three. In a further modification the sizes of the apertures 266 may vary from layer 255 to layer 255 within the stack, for example to define a cavity with a hemispherical shape.

In another alternative, the layers 256 may be replaced by layers 255, and the support plate 253 may be provided with apertures adjacent to each magnet 267, so that the cavities defined by the apertures 266 that contain the driver cone can communicate through these apertures with corresponding cavities defined by apertures 266 at behind the support plate 253.

In a modification in which the front plate 252 and the rear plate 254 are of the same material and thickness as the layers 255 and 256, the stiffness of the rear plate 254 may be increased by providing more than one rear plate 254 bolted together.

Figure 21:
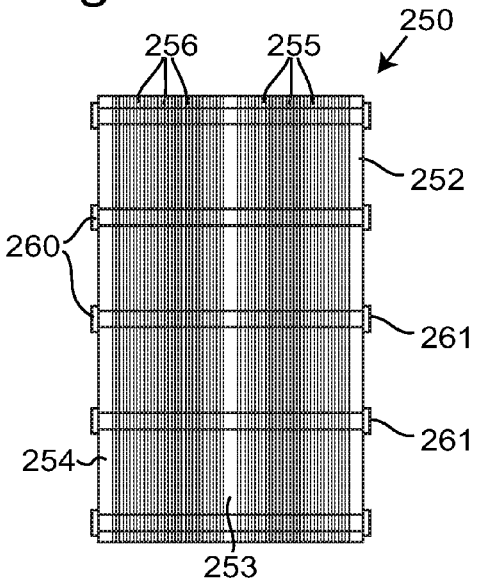
FIG. 21 is a side view of a loudspeaker.
Figure 21A:
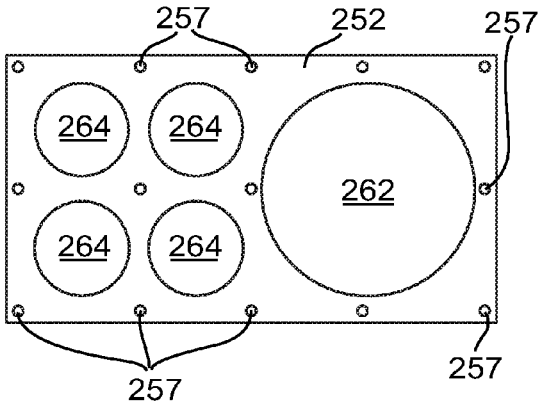
FIGS. 21*a* to 21*e* are plan views of elements that form the loudspeaker of FIG. 21.
Figure 21B:
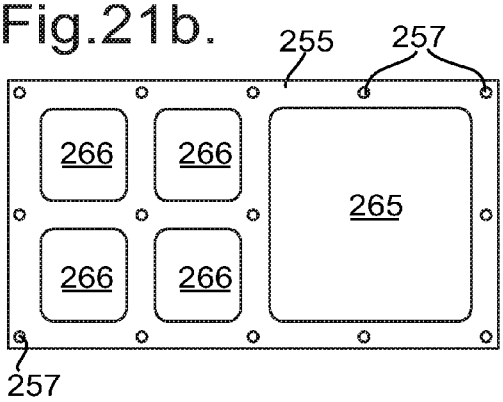
Figure 21C:
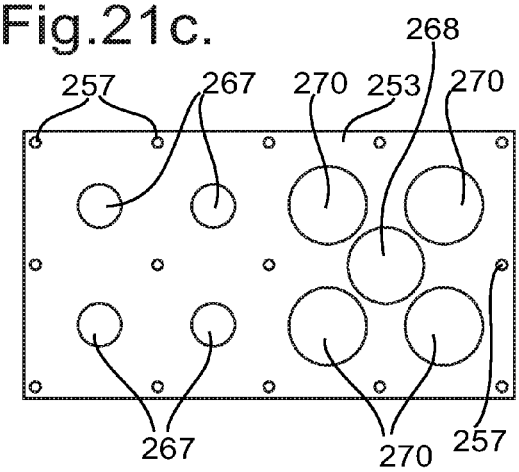
Figure 21D:
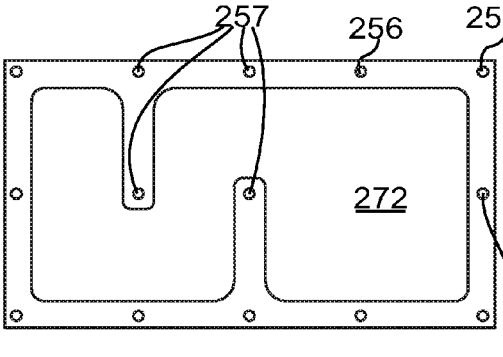
Figure 21E:
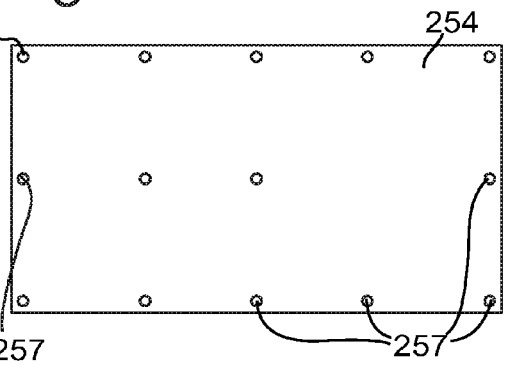

Referring back to the loudspeaker 250 of FIG. 21, if both the front plate 252 and the rear plate 254 are of a comparatively strong material such as aluminium, and are sufficiently thick, then the heads of the bolts 260 and the nuts 261 may not require washers. The layers 255 and 256 may be of a comparatively less strong material, such as MDF, or other materials such as wood, paper, or cloth, as they are under compression between the front plate 252 and the rear plate 254. If the front plate 252 is of a comparatively strong material such as aluminium, and is sufficiently thick, the nuts 261 may be omitted, and the holes 257 in the front plate 252 may be threaded, so the bolts 260 engage with the threaded holes 257; in this case if the bolts 260 are the right length to compress the assembly, then the holes 257 in the front plate 252 may be blind holes, so they are not visible from the front of the loudspeaker 250. This may enhance the appearance of the front of the loudspeaker 250. If the front plate 252 and the rear plate 254 are of a less strong material, such as those mentioned as suitable for the layers 255 and 256, then washers may be provided for the heads of the bolts 260 and for the nuts 261, to spread the load and so raise the compressive force to which the layers 255 and 256 may be subjected.

As mentioned above in relation to housings, the provision of compressive force, for example using the bolts 260, enables a rigid structure to be constructed while using comparatively low density materials, so the weight of the resulting structure can be reduced as compared to conventional construction methods that provide equivalent rigidity. The rigid structure improves the quality of the sound. In each case in which bolts are used, the bolt heads and the nuts may be provided with washers to spread the load, as this may enable a greater compressive force to be applied.

Although the compressive-force providing element may be a bolt, as in the embodiments of housings and drivers described above, it will be appreciated that other elements may be used. For example the bolts might be replaced by rivets or by pins with a slot to locate a clamping wedge. Another example would be to use external brackets or bars which are shaped to engage with the outer surfaces of the front and rear plates.

Other variations and modifications will be apparent to the skilled person. Such variations and modifications may involve equivalent and other features that are already known and which may be used instead of, or in addition to, features described herein. Features that are described in the context of separate embodiments may be provided in combination in a single embodiment. Conversely, features that are described in the context of a single embodiment may also be provided separately or in any suitable sub-combination.

It should be noted that the term "comprising" does not exclude other elements or steps, the term "a" or "an" does not exclude a plurality, a single feature may fulfil the functions of several features recited in the claims and reference signs in the claims shall not be construed as limiting the scope of the claims. It should also be noted that the Figures are not necessarily to scale; emphasis instead generally being placed upon illustrating the principles of the present invention.

The invention claimed is:

1. A housing suitable for use as a housing for an electro-acoustic transducer having a direction of movement, the housing comprising:

at least one side wall defined by at least one wall element, and wherein the housing defines a recess in which the electro-acoustic transducer may be mounted; and at least two force-spreading plates;

a multiplicity of compressing members which hold each wall element under compressive force, the compressive force being applied in a direction parallel to the direction of movement of the electro-acoustic transducer, and being applied through the force-spreading plates which are sufficiently rigid to subject each of the at least one side wall to a substantially uniform compressive force, the force-spreading plates being of a more rigid material than that of each of at least one side wall.

2. An assembly including a housing as claimed in claim 1, and an electro-acoustic transducer, the electro-acoustic transducer being mounted in the recess defined in the housing.

3. A housing as claimed in claim 1 wherein the housing includes a front plate and a back plate, spaced apart by at least one side wall, with compressing members extending between the front plate and the back plate to exert a compressive force on the side wall.

4. A housing as claimed in claim 3 wherein each side wall is of unitary form.

5. A housing as claimed in claim 3 wherein each side wall includes a plurality of wall elements held together.

6. A housing as claimed in claim 5 wherein each wall element forms part of a sheet, and the housing is formed of a plurality of sheets stacked together, at least some of the sheets defining openings to form the recess, the sheets extending in planes that are orthogonal to the direction of movement induced by the electro-acoustic transducer.

7. A housing as claimed in claim 6 wherein the front plate and the back plate are the force-spreading plates.

8. A housing as claimed in claim 6 wherein at least one of the force-spreading plates includes a plurality of separate, discrete plates, each compressing member being provided with a respective force-spreading plate, the force-spreading plates being sufficiently large in width that a magnitude of any resulting gap between adjacent force-spreading plates is no more than 20% of the distance between adjacent compressing members.

9. An assembly as claimed in claim 2 wherein the housing includes a front plate and a back plate, spaced apart by side walls, with compressing members extending between the front plate and the back plate to exert a compressive force on the side walls.

10. An assembly as claimed in claim 9, wherein each side wall is of unitary form.

11. An assembly as claimed in claim 9, wherein each side wall comprises a plurality of wall elements held together.

12. An assembly as claimed in claim 11 wherein each wall element forms part of a sheet, and the housing is formed of a plurality of sheets stacked together, at least some of the sheets defining openings to form the recess, the sheets extending in planes that are orthogonal to the direction of movement induced by the electro-acoustic transducer.

13. An assembly as claimed in claim 12 wherein the front plate and the back plate are the force-spreading plates.

14. An assembly as claimed in claim 12 wherein at least one of the force-spreading plates includes a plurality of separate, discrete plates, each compressing member being provided with a respective force-spreading plate, the force-spreading plates being sufficiently large in width that a magnitude of any resulting gap between adjacent force-spreading plates is no more than 20% of the distance between adjacent compressing members.

15. A support frame suitable for use as a support frame for an electro-acoustic transducer having a direction of movement, the support frame comprising:

at least one side wall defined by at least one wall element, and wherein the support frame defines a recess in which the electro-acoustic transducer may be mounted, at least two force-spreading plates; and a multiplicity of compressing members which hold each wall element under compressive force, the compressive force being applied in a direction parallel to the direction of movement of the electro-acoustic transducer, and being applied through the force-spreading plates, which are sufficiently rigid to subject each side wall to a substantially uniform compressive force, the force-spreading plates being of a more rigid material than that of each side wall.

16. An assembly including a support frame as claimed in claim 15, and an electro-acoustic transducer, the electro-acoustic transducer being mounted in the recess defined in the support frame.

17. A support frame as claimed in claim 15 that includes a front plate and a back plate, spaced apart by side walls, with compressing members extending between the front plate and the back plate to exert a compressive force on the side walls.

18. A support frame as claimed in claim 17 wherein each side wall is of unitary form.

19. A support frame as claimed in claim 17 wherein each side wall comprises a plurality of wall elements held together.

20. A support frame as claimed in claim 19 wherein each wall element forms part of a sheet, and the housing is formed of a plurality of sheets stacked together, at least some of the sheets defining openings to form the recess, the sheets extending in planes that are orthogonal to the direction of movement induced by the electro-acoustic transducer.

21. A support frame as claimed in claim 20 wherein the front plate and the back plate are the force-spreading plates.

22. A support frame as claimed in claim 20 wherein at least one of the force-spreading plates include a plurality of separate, discrete plates, each compressing member being provided with a respective force-spreading plate, the force-spreading plates being sufficiently large in width that a magnitude of any resulting gap between adjacent force-spreading plates is no more than 20% of the distance between adjacent compressing members.

23. A method of manufacturing an assembly comprising a housing and an electro-acoustic transducer having a direction of movement, the method comprising forming a housing defining a recess, and installing the electro-acoustic transducer in the recess in the housing, wherein the housing comprises at least one side wall defined by at least one wall element, and at least two force-spreading plates, and the method includes subjecting the at least one wall element of the at least one side wall to a compressive force, the compressive force being applied by a multiplicity of compressing members, and being applied through the force-spreading plates which are sufficiently rigid to subject each of the at least one side wall to a substantially uniform compressive force, the force-spreading plates being of a more rigid material than that of each of the at least one side wall, and the compressive force being sufficient to suppress resonance of each of the at least one side wall, and being applied in a direction parallel to the direction of movement of the electro-acoustic transducer.

24. A method as claimed in claim 23, wherein the housing comprises at least one side wall defined by a multiplicity of sheets stacked together and secured together, the sheets being in planes that are orthogonal to the direction of movement of the movable element.

25. A method as claimed in claim 23 wherein the compressive force is applied by compressing elements comprising bolts, and the method includes tightening the bolts to a torque at least 25% greater than that required to hold the wall elements together.

26. A method as claimed in claim 25 wherein the method includes tightening the bolts to a torque at least twice that required to hold the sheets together.

* * * * *